US006705537B2

(12) United States Patent
Schultz et al.

(10) Patent No.: US 6,705,537 B2
(45) **Date of Patent: *Mar. 16, 2004**

(54) ORBITAL APPLICATOR TOOL WITH SELF-CENTERING DISPERSING HEAD

(75) Inventors: Carl L. Schultz, Plymouth, MI (US); Scott Taylor, Westland, MI (US)

(73) Assignee: Sealant Equipment & Engineering, Inc., Plymouth, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/849,682

(22) Filed: May 4, 2001

(65) Prior Publication Data

US 2001/0038039 A1 Nov. 8, 2001

Related U.S. Application Data

(63) Continuation-in-part of application No. 09/818,422, filed on Mar. 27, 2001, and a continuation-in-part of application No. 09/818,180, filed on Mar. 27, 2001.

(60) Provisional application No. 60/201,924, filed on May 5, 2000.

(51) Int. Cl.[7] ..... B05B 17/00

(52) U.S. Cl. ..... 239/1; 239/227; 239/237; 239/236; 239/380; 239/463

(58) Field of Search ..... 239/227, 237, 239/240, 243, 261, 264, 380, 398, 476, 463, 481, 487, 503, 507–518, 548, 399, 406–410, 434.5, 106, 107, 570–572, 583; 222/145.6, 145.5, 146.1

(56) References Cited

U.S. PATENT DOCUMENTS

| | | | | |
|---|---|---|---|---|
| 3,094,254 A | | 6/1963 | Cullen et al. | |
| 3,228,661 A | | 1/1966 | Rose | |
| 3,369,758 A | | 2/1968 | Hruby, Jr. | |
| 3,874,595 A | | 4/1975 | Rindisbacher | |
| 3,916,568 A | * | 11/1975 | Rose | 451/92 |
| 4,369,850 A | | 1/1983 | Barker | |
| 4,659,018 A | | 4/1987 | Shulman | |
| 4,662,565 A | * | 5/1987 | Waldrum | 239/227 |
| 4,761,039 A | * | 8/1988 | Hilaris | 239/264 |
| 4,809,885 A | | 3/1989 | Hayashi et al. | |
| 4,872,417 A | | 10/1989 | Kuwabara et al. | |
| 5,163,615 A | * | 11/1992 | Bauer | 239/237 |
| 5,188,293 A | * | 2/1993 | Burton | 239/227 |
| 5,248,095 A | | 9/1993 | Rankin et al. | |
| 5,598,975 A | | 2/1997 | Jager | |
| 5,794,854 A | | 8/1998 | Yie | |
| 5,826,978 A | * | 10/1998 | Zikeli et al. | 366/176.4 |
| 5,979,794 A | | 11/1999 | DeFillipi et al. | |
| 6,283,832 B1 | * | 9/2001 | Shepherd | 451/40 |

FOREIGN PATENT DOCUMENTS

| | | |
|---|---|---|
| EP | 0 203 830 A1 | 12/1986 |
| EP | 0 852 160 A2 | 7/1998 |
| FR | 2.178.454 | 11/1973 |
| WO | WO99/59732 | 5/1998 |

* cited by examiner

*Primary Examiner*—Dinh Q. Nguyen
(74) *Attorney, Agent, or Firm*—Young & Basile, P.C.

(57) ABSTRACT

An apparatus imparts movement to a fluid dispersing nozzle with a mechanism for converting rotational movement about an axis of rotation into orbital movement about the axis of rotation, and an elongate member is connectable to the mechanism at one end and is connectable to a fluid nozzle at an opposite end from the mechanism. The orbital member provides orbiting movement of the opposite end in response to rotation of the mechanism about the rotational axis, and provides stationary centered positioning of the opposite end in response to a non-rotating mechanism. A speed multiplier transmission or gearbox can be provided between the motor shaft and drive spindle if desired. A separate mixer is positionable within the member and is moveable longitudinally with respect to the member during use. The mixer includes a valve member connected to one end for movement relative to a valve seat defined by an inner surface of the cone.

58 Claims, 14 Drawing Sheets

ORBITAL APPLICATOR TOOL WITH SELF-CENTERING DISPERSING HEAD

RELATED APPLICATIONS

This application is a continuation-in-part of U.S. provisional patent application Serial No. 60/201,924 filed May 5, 2000, and U.S. patent application Ser. Nos. 09/818,422 and 09/818,180, both filed on Mar. 27, 2001.

FIELD OF THE INVENTION

The present invention is directed to an orbital applicator tool for use in combination with a stationary or moveable support, such as a robot, xyz table, or similar motion equipment, to form a dispensing system in which at least one ribbon or bead of material having a variable width and thickness can be applied to a work piece or substrate in a predetermined selectable and/or programmable pattern by moving the dispensing head relative to the workpiece or moving the workpiece relative to the dispensing head.

BACKGROUND OF THE INVENTION

The automotive industry is increasingly using a wide variety of adhesives and sealants in the production of vehicles. For example, adhesives and sealants are used in the assembly of hem-flanged parts, such as doors, decks, and hoods. By way of example, sealing materials can be used independent of other mechanical means, or can be used in combination with more conventional connecting means, such as spot-welding techniques. In spot-welding techniques, the sealant is first applied and then the sheet metal is welded through the sealant. The combined sealant and spot-weld configuration allows the distance between spot-welds to be increased while reducing the number of welds required. Alternatively, welding is being eliminated by employing greater use of structural adhesives.

The use of sealants and adhesives in automated assembly can create problems if the material is improperly applied. For example, if the dispersal pattern extends beyond the end of the work piece, the work area can be subjected to over spray requiring cleaning. If excessive volume of material is applied in a hemming operation, the material can contaminate the paint primer base prior to painting. Excessive material can also contaminate hemming dies, and adversely impact the ability to paint over exposed adhesive or sealant that has been expelled from joints because of the application of excessive volumes. Therefore, it is desirable to apply the material accurately along a predetermined path within a required cycle time with a predetermined volume and dispersal pattern to provide correct bonding or sealing for the particular application.

SUMMARY OF THE INVENTION

The present invention is mountable on the end of a robot arm for applying adhesives and sealers in a swirling pattern to various automotive body parts, by way of example and not limitation, primarily for use in applications known as hem-flange bonding and seam sealing. Applying materials in a wide swirl pattern, as opposed to a single bead form, has certain advantages in the assembly process. The present invention includes a two-pivot bearing; one of which can be positioned off center in a rotating orbital housing, thus achieving an orbiting tip. Rotating power is provided by separate remote in-line or side-mounted motor of an electric, air, or hydraulic type. The present invention permits the ability to increase speed ranges of the orbiting tip by changing a pulley size.

In one embodiment, the entire valve is orbited, while in another embodiment, the valve is remotely mounted and only the nozzle and tip are orbiting. The remote valve version is preferable due to decreased weight, and reduced vibration. The present invention permits the capability to electronically reposition the tip offset during a bead application cycle without stopping the movement of the robot along the desired path. Repositioning the tip offset during a bead application cycle affects a programmable change in the swirl pattern width. By allowing programmable changes in the predetermined application pattern, the same tool can be used for streaming applications, where the motor is stopped, thereby stopping the swirling action, and the materials are streamed or squirted in a single uniform bead along a predetermined path of a part surface, by way of example and not limitation, such as doors, hoods, or other automotive body panels. Presently, orbiting or swirling applicators are unable to accurately predict where the offset tool tip is pointing when the motor is stopped, and therefore the material stream does not consistently hit the target path as the tool tracks around the part surface. The present invention moves the orbital bearing to a null or centered position thereby centering the tip along the tool center line in a predictable and repeatable manner. The tip is returned to a center null position either mechanically or electromechanically stopping the motor in a predictable position.

In another embodiment, a nozzle design is provided with a tip seal shut-off. The tip seal shut-off nozzle provides instantaneous cut-off of the material stream right at the tip of the nozzle. The present invention in each of the embodiments can be used for dispensing both single and plural component materials. In a plural component material configuration, an inline disposable mixer nozzle can be provided. Static mixers tend to drip because the fluid shut-off point is upstream from the mixing tube assembly. The mixing tube assembly generally consists of a tube housing, and a length of static elements, typically in one unitary piece, that are loosely contained in the tube. By attaching a valve head to the exit end of the static mixer element, and then pushing the static mixer element and attached valve head, or pulling the element assembly within the tube, an instant shut-off or cut-off of materials at the tip is achieved, i.e. porting or unporting the tip orifice.

The present invention can be used for applying materials in a swirled pattern, or in a direct stream. The pattern generating device can be powered by any suitable motor including electric, air, or hydraulic type of motors. The present invention provides for variable orbit speed, and preferably it is programmable to provide the variable orbit speed required for different application cycles, or during the same application cycle. The variable orbit speed can be synchronized with robot commands as required for specific application cycles. The orbit generating device can be powered by a direct drive, or by an off-set drive configuration. The present invention permits automatically changing from a predetermined swirl pattern to a predetermined null or centered position for streaming application portions of a cycle on the fly (without stopping) via programmed robot command that stops the motor and tool rotation.

The present invention has applications in the hem-flanging process, and also in the seam sealing and sound deadner process commonly used in automated automobile assembly. The ability of the present invention to turn in a circular motion without winding up the material hoses and control lines, make the present invention suitable for other applications including for example, coating the interior of a conduit such as large pipes. In such an application, the adhesive head can be replaced with a spray head on a boom for painting conduit interiors. The swirl diameter is controlled by the degree of orbit ball off-set from the center line. The degree of off-set of the orbit ball can approach up to a maximum of approximately 90°; however, the maximum degree of off-set of the orbit ball depends on the construction of the orbit housing selected for the particular application. The diameter of the swirl pattern is also dependent on the distance between the orbiting tip and the surface of the part. The swirl diameter and swirl pitch (frequency of loops per inch) is a factor of orbiting speed, to speed along a given path (surface speed) and the distance between the tip/nozzle and the part surface. The orbital off-set adjustment can be accomplished with a rotatable element having an angular bore, where the degree of off-set can be varied by moving the angular bore element or housing forward and aft along a center line of rotation. The angular bore element or housing can be moved manually for changing the orbit angle, or can be moved automatically by, for example a ball screw drive moving the housing fore and aft along the center line of rotation. A ball can be received within the angular bore element or housing for sliding movement within the angled bore to change the radial distance of off-set from the center line of rotation from a zero or null, centered position to a maximum position providing for the maximum radius of circular sweep driven by the angled bore or slot through the element or housing. The rotational circular sweep movement imparted by the ball disposed within the angled slot provides for changing the radius of sweep by moving the angled bore housing with respect to the ball, or by moving the ball with respect to the angled bore housing to change the radius of sweep with respect to the center line from a zero or null, centered position to a maximum value for the radius of sweep. Alternatively, the orbiting ball can be mounted in a moveable plate encased within a rotatable orbit housing, where the movable plate can be disposed at an on-center, zero, null, or off-centered position up to a maximum radial distance value spaced from the center line of rotation.

The applicator tool according to the present invention can be jacketed, or ported, for fluid temperature control purposes. The beads or swirls of material dispensed by the applicator tool can be applied to flat, vertical, and overhead surfaces. The applicator tool can be used with single and plural component materials. The materials to be dispensed are supplied by various pumps and fluid metering systems known to those skilled in the art. Dispense heads according to the present invention can incorporate streaming tip style nozzles with single, or multiple round, or slotted type orifices, to create a multitude of bead or stream patterns. Tips can be encased in a commercially available REVERSE-A-CLEAN™ cleaning device to conveniently back flush a plugged orifice.

In one configuration, the material valve or valves can be mounted in line with the circular sweeping element. Alternatively, the material valve or valves can be mounted remote from the circular sweep element to reduce the weight of the orbiting object and the resultant vibration. Remote mounting of the material valve or valves is preferable for high-speed applications. Orbiting speeds for a hem-flange application are expected to be in the range of approximately 5,000 revolutions per minute. Orbiting speeds for a seam sealer application are expected to be in a range of up to 24,000 revolutions per minute. High speeds can create high bearing surface speeds and heat. The bearings of the present invention are large enough to provide sufficient room to introduce lubrication and cooling techniques as required, such as fins, fluids, or the like, and are enclosed in an encasement that is free to align itself with a center line of rotation.

Another aspect of the present invention is a tip seal valve shut-off feature. The tip seal valve shut-off feature provides instant start and stop of beads, thereby eliminating material trails or tails. The quick on-off response time is desirable at high robot travel speeds. The quick on-off response time can apply stitches of material spaced from one another along a predetermined path of travel. The tip seal valve shut-off preferably is mounted to, or integrally formed with, a static mixer element adjacent the exit end and movable into contact with a tapered portion of the discharge tip of the applicator tool. The static mixer element and connected valve head can be moved longitudinally within the housing between a valve open and a valve closed position to provide the shut-off feature.

Another aspect of the present invention is a shield feature. The shield provides an inexpensive and easily installed method of preventing material from being directed away from the workpiece. The shield can be made of a disposable material such as plastic or paper so that cleaning of the shield is unnecessary. The shield can be connected to the orbital applicator tool with an O ring or a strap. The shield includes an opening to allow connection of the inlet port to the applicator tool.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED AND ALTERNATIVE EMBODIMENTS

Various embodiments are shown throughout the figures illustrating the present invention, and include common elements in different structural configurations where common elements are designated with a common base numeral and differentiated with a different alphabetic designation for the various embodiments. Descriptions for the base numeral designations are considered to be generic to the different alphabetic extensions added to the alternative embodiments except as specifically noted herein. It should be understood that off center adjustment greater than 10° can be provided if desired in a particular application.

Figure 1:
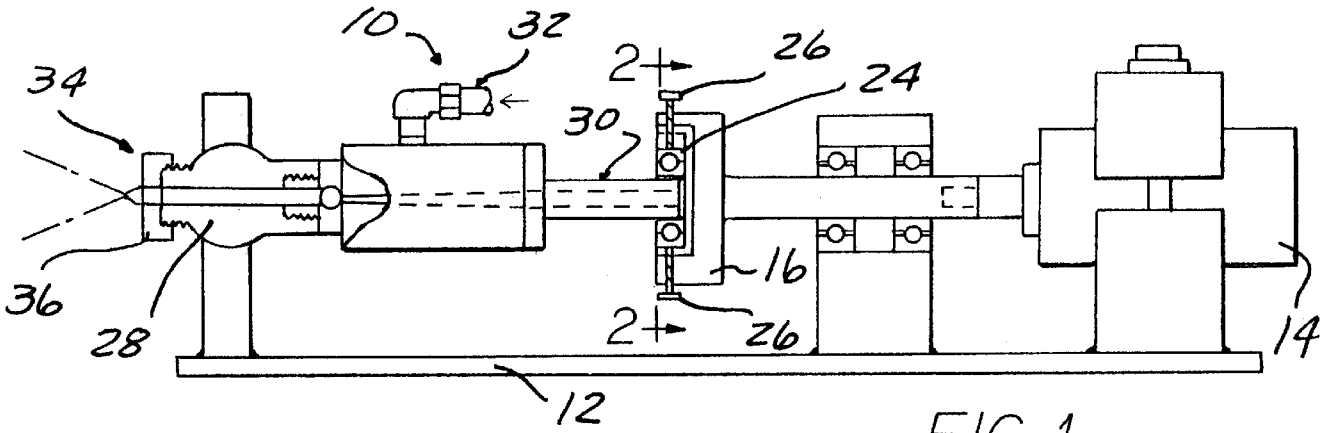
FIG. 1 is a side elevational view of a first embodiment of an orbital applicator tool according to the present invention.

Referring now to FIG. 1, an orbital applicator tool 10 according to the present invention is illustrated having a base 12 connectable to a support structure, such as a fixed frame or movable support, such as a robotic arm for application of material to a work piece. A motor 14 is connected with respect to the base for providing rotational drive input to a rotatable element or housing 16. In the illustrated embodiment of FIG. 1, the motor is supported in an in-line configuration to the rotational axis of the rotatable element or housing 16. Other alternative configurations for providing rotational input to the rotatable element or housing 16 can be provided as required for the particular application.

As best seen in FIGS. 2, and 4–7, the rotatable element or housing 16 includes a slide pocket 18 having opposing side walls 20, 22 extending radially and axially with respect to the axis of rotation. A plate or bearing 24 is disposed within the slide pocket 18 for adjustable movement radially with respect to the axis of rotation of the rotatable element or housing 16. The radial off-set movement of the plate or bearing 24 preferably includes movement from a zero, null, or centered position where the axis of rotation of the bearing is coaxial with the axis of rotation of the rotatable element or housing, out to a maximum radially off-set position as defined by the maximum radial length of the slide pocket 18. The plate or bearing 24 can be adjusted in its radial position within the slide pocket 18 of the rotatable element or housing 16 by adjustment screws 26. The adjustable movement of the plate or bearing 24 off from the center line of the axis of rotation for the rotatable element or housing 16 preferably provides an adjustment to achieve up to approximately 10° of off center movement as measured between the central point of the plate or bearing 24 and the central pivoting point of an orbiting ball 28.

The orbiting ball 28 is supported with respect to the base 12 for fixing a central point for movement of the orbital element or member 30. The orbital ball connection 28 allows the orbital member 30 to sweep through orbital circular movements at opposite longitudinal ends of the orbital element or member 30 as one end of the orbital element or member 30 is driven by its attachment to the plate or bearing 24 being rotated by the rotatable element or housing 16 and motor 14. At least one material inlet port 32 is provided along the longitudinal length of the orbital element or member 30. The material passing through the orbital element or member 30 is discharged through at least one material outlet port 34, such as through an attached nozzle, sprayer, streamer, or dispersing head 36. As illustrated in FIG. 1, a control valve 38 can be provided for turning the supply of material to the outlet port on and off. In the illustrated embodiment of FIG. 1, the control valve 38 is positioned in line with the longitudinal axis of the orbital element or member 30 between the orbiting ball connection 28 and the connection of the longitudinal end adapted to engage with the plate or bearing 24.

Figure 3:
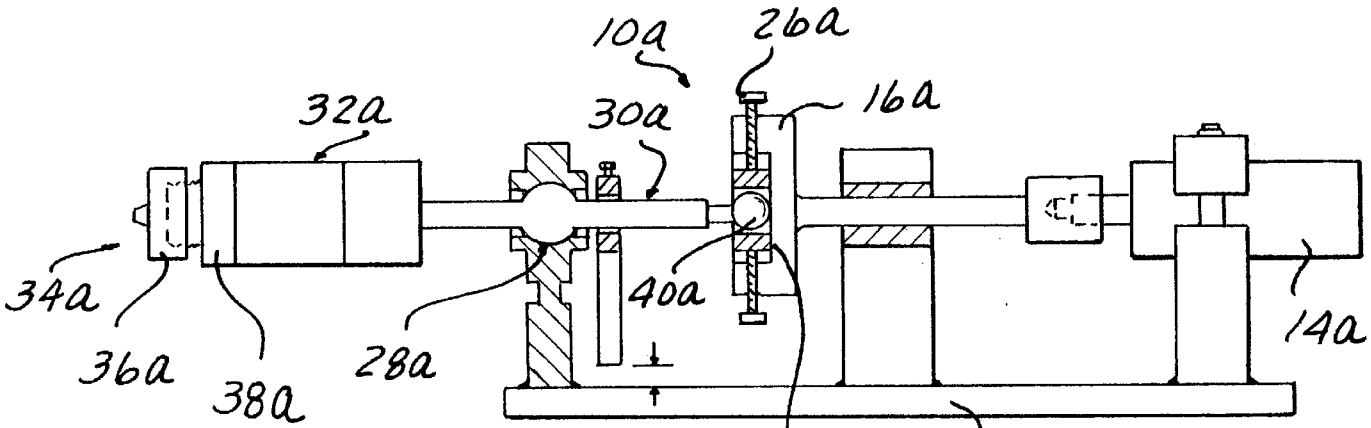
FIG. 3 is a side elevational view of an alternative embodiment of the orbital applicator tool according to the present invention.
Figure 2:
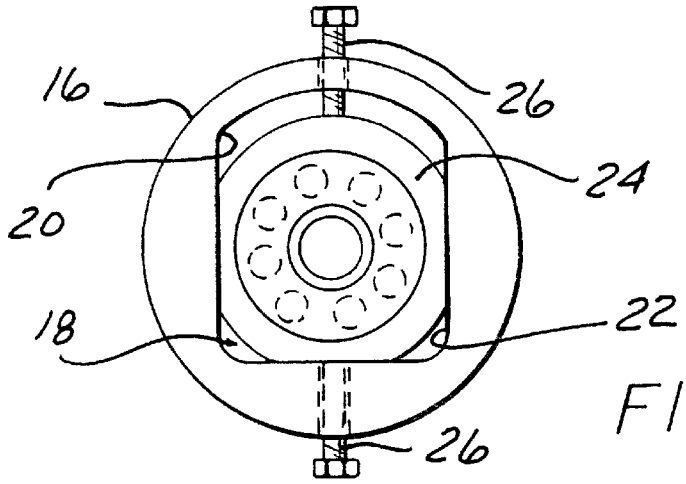
FIG. 2 is a cross sectional view taken as shown by line 2—2 in FIG. 1.
Figure 5:
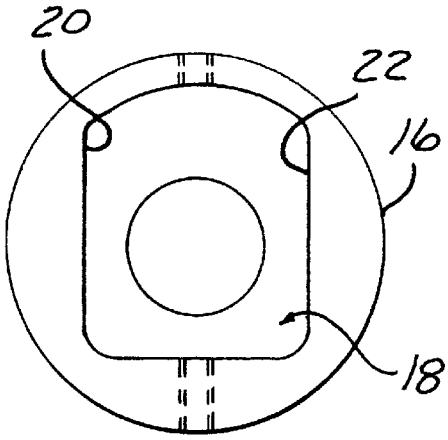
FIG. 5 is an end view of the rotatable element or housing illustrated in FIG. 4.
Figure 4:
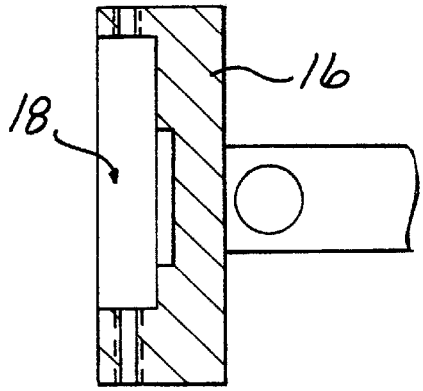
FIG. 4 is a cross sectional view of the rotatable element or housing for converting rotation about an axis of rotation into circular sweeping movement of a tip or nozzle according to the present invention.
Figure 6:
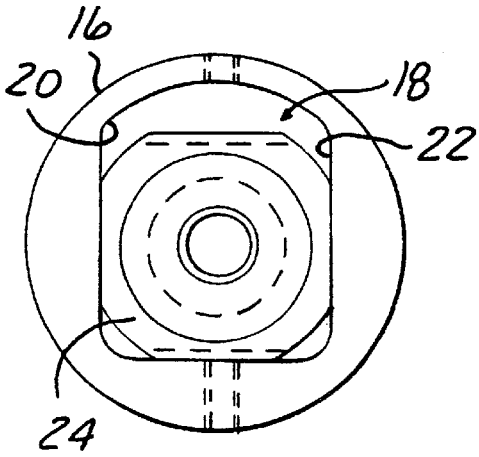
FIG. 6 is an end view of a bearing member disposed within the slide pocket of the rotatable element or housing illustrated in FIGS. 4 and 5.
Figure 7:
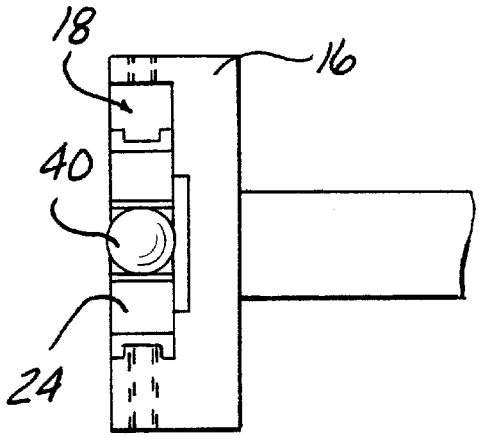
FIG. 7 is a side elevational view of the rotatable housing and bearing member disposed within the slide pocket of the rotatable housing as illustrated in the end view of FIG. 6.

Referring now to FIG. 3, an alternative embodiment of the orbital applicator tool 10*a* according to the present invention is illustrated. The orbital applicator tool 10*a* includes a base 12*a*, motor 14*a*, rotatable element or housing 16*a*, slide pocket 18*a*, plate or bearing 24*a*, and adjustment screws 26*a*. The orbiting ball connection 28*a* and orbital element or member 30*a* operate as previously described in the embodiment of FIG. 1. In the illustrated embodiment of FIG. 3, the at least one material inlet port 32*a* and control valve 38*a* are positioned in line along the longitudinal axis of the elongated or orbital element or member 30*a*. In the embodiment illustrated in FIG. 3, the inlet port 32*a* and control valve 38*a* are disposed between the at least one material outlet port 34*a*, such as a nozzle, sprayer, streamer, or dispersing head 36*a*, and the orbiting ball 28*a*.

Figure 8:
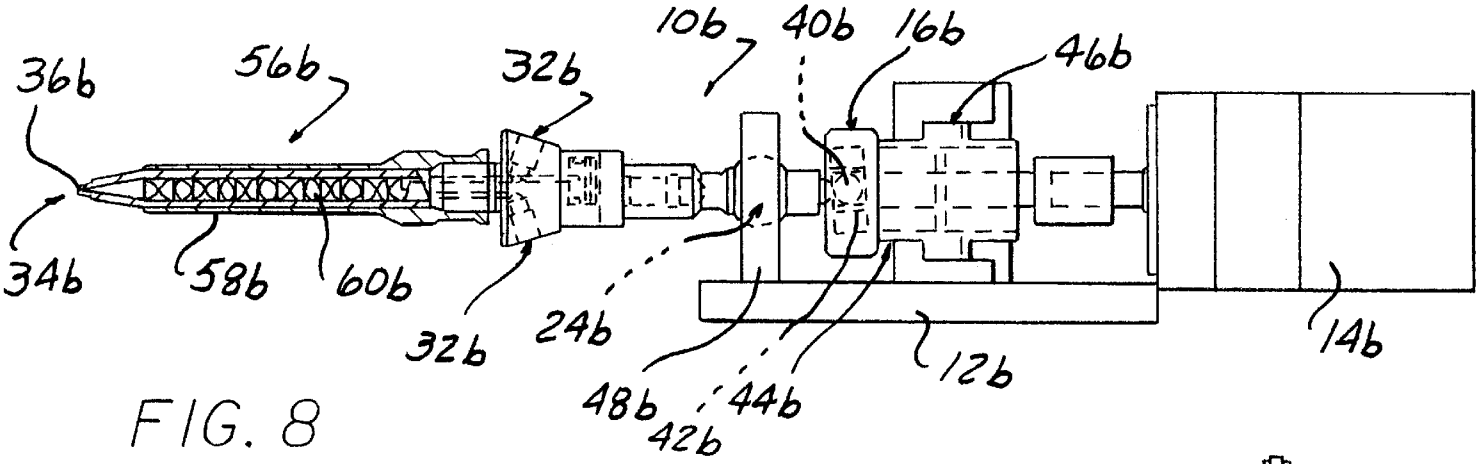
FIG. 8 is a side elevational view of an alternative configuration of the orbital applicator tool according to the present invention for applying a two part material with a remote mounted valve unit and means for adjusting the radius of circular sweep between a zero, null or centered position to a maximum radial off-set position from the rotational axis.

Referring now to FIG. 8, another embodiment of the orbital applicator tool 10*b* is illustrated. The orbital applicator tool 10*b* includes a base 12*b*, motor 14*b*, rotatable element or housing 16*b*, orbiting ball 28*b*, and orbital element or member 30*b*. In the illustrated embodiment, two material inlet ports 32*b* are provided for a two part material to be applied through the applicator tool 10*b*. The control valve is not illustrated in FIG. 8, since it is mounted remotely in this configuration. At least one material outlet port 34*b*, such as a nozzle, sprayer, streamer, or dispersing head 36*b* is also illustrated. The orbital element or member 30*b* includes a ball element 40*b* at one longitudinal end engagable within an angled slot 42*b* formed within the rotatable element or housing 16*b*. The ball element 40*b* engages within the angled slot 42*b* allowing radial adjustment of the orbital radius of sweep from a zero, null, or centered position with respect to the rotational axis of the rotatable element or housing 16*b* to a maximum radial off-set distance value. The adjustment of the off-set radius for the ball element 40*b* can be accomplished by moving the ball element 40*b* and angled slot 42*b* with respect to one another longitudinally along the rotational axis of the rotatable element or housing 16*b*. At one longitudinal end of the angled slot 42*b*, the ball element 40*b* is in a centered or null position with respect to the rotational axis of the rotatable element or housing 16*b*. At an opposite end of the angled slot 42*b*, the maximum radial off-set distance is provided to create the maximum radius of the orbital sweep pattern for the applicator tool 10*b*. The ball element 40*b* slides within a sleeve of angled slot 42*b*. The sleeve of angled slot 42*b* is pressed into a bearing race and is rotatable. The bearing reduces friction between the ball element 40*b* and the sleeve of the angled slot 42*b*. To change the offset from the rotational centerline of the rotatable member 16*b*, the ball element 40*b* moves fore and aft slightly within the sleeve of the angled slot 42*b*. When rotating, the ball element 40*b* is forced against the wall of the sleeve of the angled slot 42*b*, and the sleeve is free to rotate.

Movement of the ball element 40*b* and angled slot 42*b* relative to one another can be accomplished by supporting the rotatable element or housing 16*b* on a slidable member with respect to the base 12*b* allowing relative movement of the angled slot 42*b* with respect to the ball element 40*b*. The movable support element 44*b* for the rotatable element or housing 16*b* can be driven in movement by any suitable device. By way of example and not limitation, a piston and housing arrangement 46*b* can be provided for operation with any suitable source of pressurized fluid, such as air, or hydraulic. Alternatively, an electric solenoid operator can be provided for driving the movable support element 44*b* between the end limits of travel. In the preferred configuration, an electric servo motor can be provided for driving a screw and nut arrangement to adjust the position of the movable support element 44*b* between the end limits of travel and selectively stop at any position between those end limits of travel in response to programmable signals sent to the servo motor according to a control program. Alternatively, the support element 48*b* for the orbiting ball 28*b* could be movable with respect to the base 12*b* in order to move the ball element 40*b* with respect to the angled slot 42*b*. In this configuration (not shown) the support element 48*b* can be moved longitudinally with respect to the rotational axis of the rotatable element or housing 16*b* by any suitable driver, by way of example and not limitation, such as a piston and housing assembly driven by an appropriate source of pressurized fluid, electric actuator, servo motor, screw and drive nut assembly, or the like. In the embodiment illustrated in FIG. 8, the motor 14*b* is illustrated as being in line with the rotational axis of the rotatable element or housing 16*b*.

Figure 9:
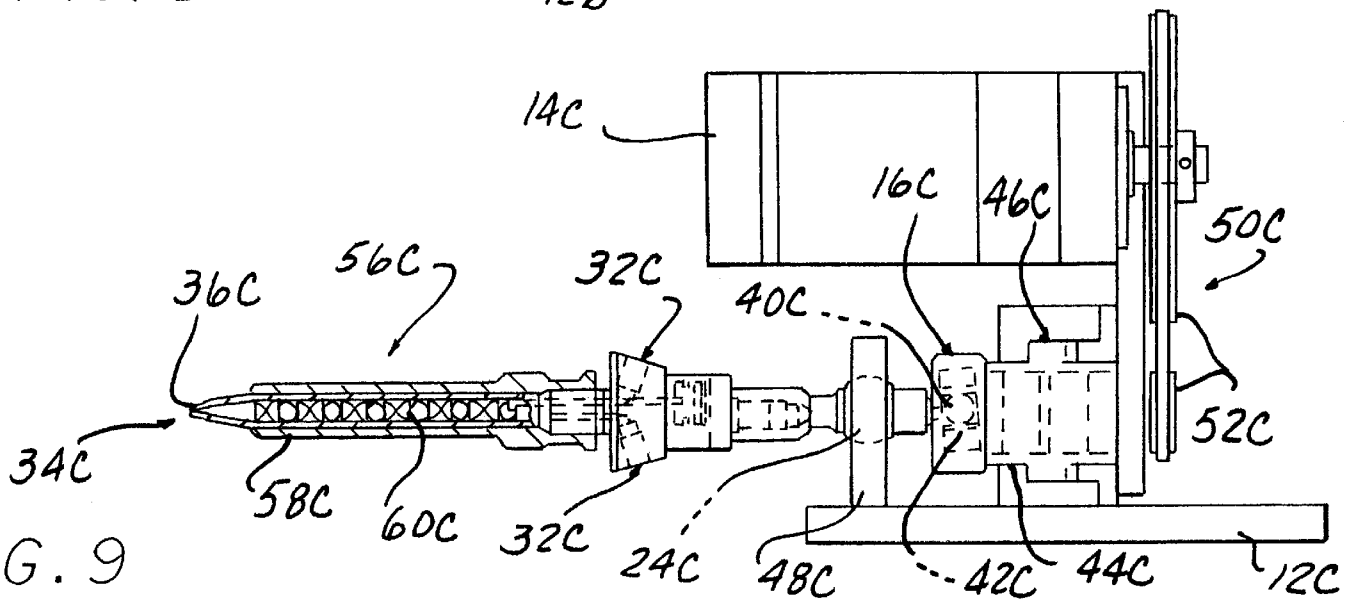
FIG. 9 is an alternative configuration of the orbital applicator tool according to the present invention with a motor off-set for driving the orbital circular sweeping movement of the applicator tip or nozzle through a pulley arrangement allowing adjustable speed changes by changing the pulley ratios.

Referring now to FIG. 9, an alternative configuration for the orbital applicator tool 10*c* is illustrated. The orbital applicator tool 10*c* includes a base 12*c*, motor 14*c*, rotatable element or housing 16*c*, orbiting ball 28*c*, and orbital element or member 30*c*. At least one material inlet port 32*c* is provided. At least one material outlet port 34*c* is provided, such as a nozzle, sprayer, streamer, or dispersing head 36*c*. The control valve is not illustrated in this embodiment, since it is mounted remotely in this configuration for supplying a two part material to the applicator tool through two material inlet ports 32*c*. The ball element 40*c* is movable within the angled slot 42*c* for adjusting the radius of orbital sweep as described in greater detail above. In this configuration, the motor 14*c* is illustrated as being off-set from the rotational axis of the rotatable element or housing 16*c* and drives the rotatable element or housing 16*c* through a transmission 50*c*, by way of example and not limitation, such as through a belt and pulley arrangement 52*c*. The belt and pulley arrangement allows adjustment of the rotational speed of the dispersing head by changing the pulley ratio.

Figure 10:
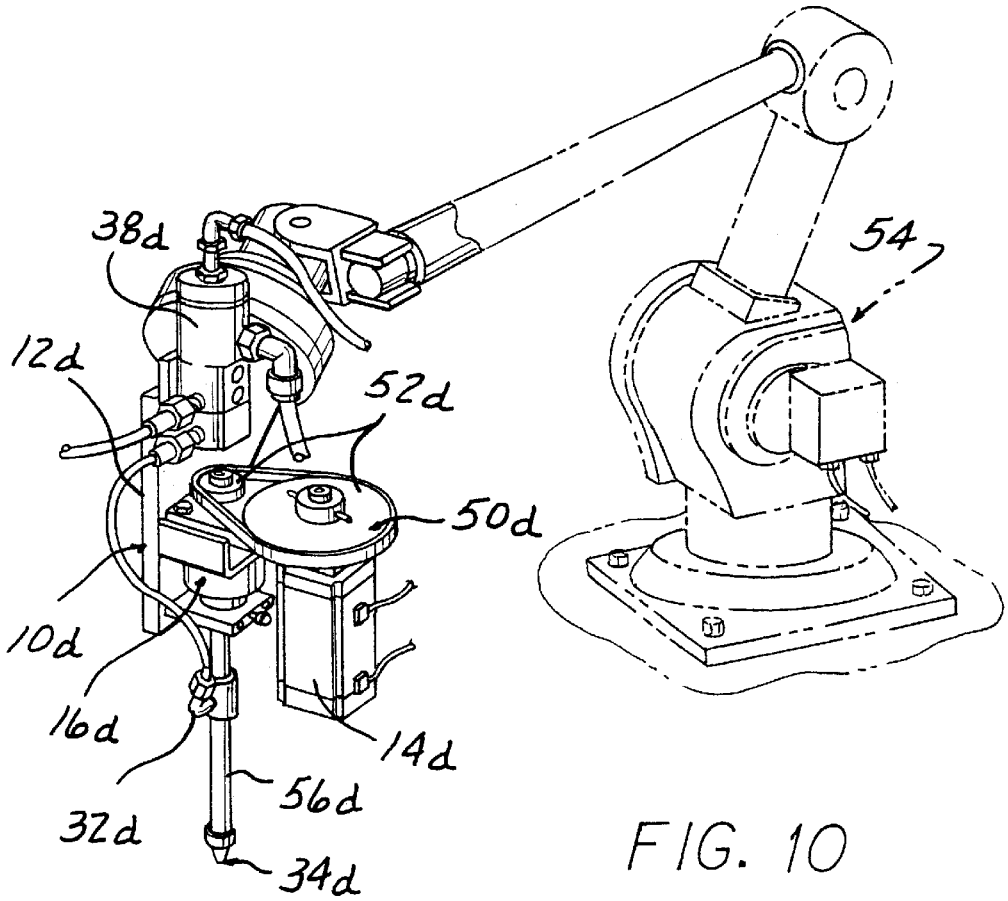
FIG. 10 is an orbital applicator tool attached to a robotic arm for movement along programmable three-dimensional predetermined paths for applying materials through the applicator tool to work pieces on a production basis.

Referring now to FIG. 10, an orbital applicator tool 10*d* is illustrated connected to a robot 54. The orbital applicator tool 10*d* includes a base 12*d*, motor 14*d* off-set from the rotational axis of the rotatable element or housing 16*d* for driving the orbital element or member 30*d* about the fixed point of the orbiting ball 28*d*. The motor 14*d* is connected to drive the rotatable element or housing 16*d* through a transmission 50*d*, such as the belt and pulley arrangement 52*d*. At least one material inlet port 32*d* is provided for supplying material to at least one material outlet port 34*d*, such as a nozzle, sprayer, streamer, or dispersing head 36*d*. The control valve 38*d* in this embodiment is mounted remote from the orbital element or member 30*d*.

Figure 11:
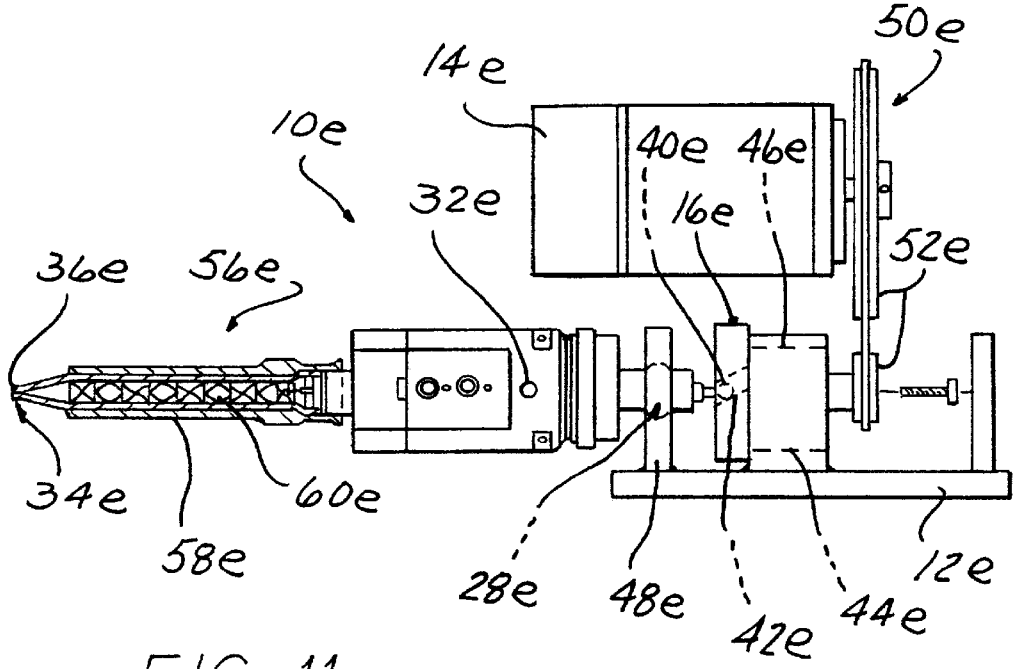
FIG. 11 is a side elevational view of an alternative embodiment of the orbital applicator tool as shown in FIGS. 9 and 10 with the motor off-set from an inline position and using a pulley arrangement for transmitting power to the rotatable member, and further including an inline valve assembly for feeding material to the applicator tool.

Referring now to FIG. 11, an alternative embodiment of an orbital applicator tool 10*e* is illustrated. The orbital applicator tool 10*e* includes a base 12*e*, motor 14*e*, rotatable element or housing 16*e*, orbiting ball 28*e*, orbital element or member 30*e*, at least one material inlet port 32*e*, at least one material outlet port 34*e*, such as a nozzle, sprayer, streamer, or dispersing head 36*e*, and a control valve 38*e* shown as being in line with the orbital element or member 30*e* in the illustrated embodiment. The ball element 40*e* is engagable within an angled slot (not shown) for adjustment of the radius of orbital sweep from a zero, null, or centered position with respect to the rotational axis of the rotatable element or housing 16*e* to a maximum off-set radius as described in greater detail above. The ball element 40*e* can be moved relative to the angled slot (not shown) by movement of the support element for the rotatable element or housing 16*e*, or by movement of the support element for the orbiting ball as previously described above. In this embodiment, the motor 14*e* is illustrated as being in an off-set position with respect to the rotatable element or housing 16*e* which is driven through a transmission 50*e*, such as a belt and pulley arrangement 52*e*.

Figure 12:
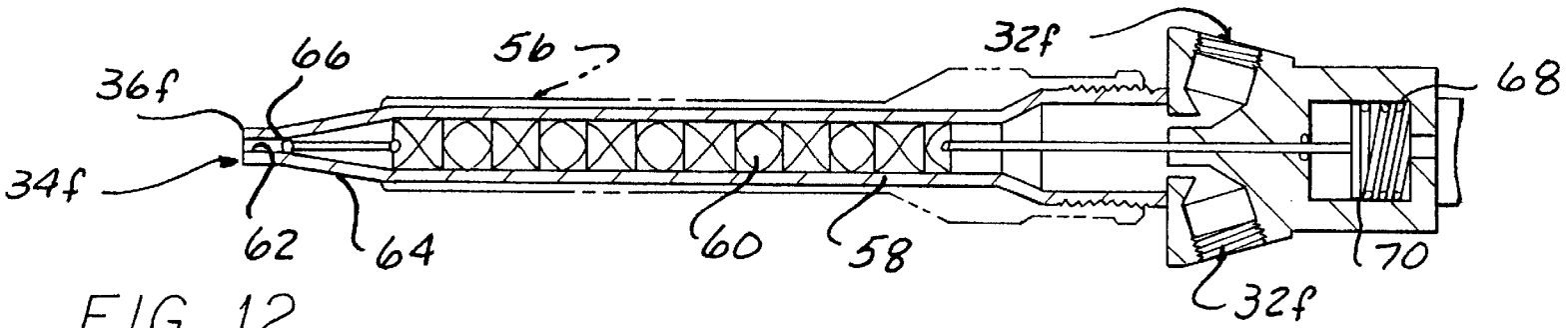
FIG. 12 is a cross sectional detailed view of a tip seal valve and mixer nozzle according to the present invention.

Referring now to FIG. 12, a dispenser tip nozzle 56 is illustrated according to the present invention. The dispenser tip nozzle 56 includes at least one material inlet port 32*f* and at least one material outlet port 34*f*. Preferably, the dispenser tip nozzle 56 includes a mixer housing 58 enclosing a mixer element or assembly 60 for thoroughly mixing a two part material with respect to one another prior to discharge through the at least one material outlet port 34*f*. The mixer housing 58 receives the material from the at least one material inlet port 32*f* in communication with one end of the mixer housing 58. An opposite end of the mixer housing 58 includes at least one material outlet port 34*f* for discharging the material. Preferably, the at least one outlet port 34*f* is defined by the mixer housing 58 tapering conically to a tip formed from either the same material as the mixer housing 58, or as an insert, composed of a suitable material, such as steel, connected to the mixer housing 58. The inner surface 62 of the conical tip 64 defines a valve seat for engagement with a valve member 66 formed of any suitable material composition and shape for the particular application. By way of example and not limitation, the valve member 66 can be in the form of a spherical member, partial spherical member, tapered cone, or wire plug connected to or integrally formed with the mixer element or assembly 60. In the embodiment illustrated in FIG. 12, a wire support member is connected between the spherical valve member 66 and the mixer element or assembly 60. The valve member 66 and mixer element 60 are movable longitudinally within the mixer housing 58 to move the valve member 66 from a closed or off position in engagement with the inner surface 62 of the conical tip 64 to a spaced or open position allowing material to flow out of the at least one material outlet port 34*f*. The mixer element 60 can be a static mixer element or can be a rotating mixer element driven by a motor. The mixer element 60 and valve member 66 are preferably disposable elements that can be replaced with a new mixer element and valve member eliminating the need for solvent flushing to clean the assembly. The illustrated embodiment in FIG. 12, includes a spring 68, which acts in combination with the flow of material on the mixer assembly, to force the valve member 66 into the tip stopping material flow. A source of pressurized fluid, such as compressed air is provided to one side of a piston 70 opposite from the spring 68 such that the compressed fluid forces the piston 70 against the spring 68 pulling the mixer element 60 toward the entrance end of the mixer housing 58 thereby lifting the valve member 66 off from the valve seat defined by the inner surface 62 of the conical tip 64 so that material can exit from the at least one outlet port 34*f*. Alternatively, an electrical solenoid can be provided in place of compressed fluid for actuating the valve from the normally sealed position to the open position.

Figure 13:
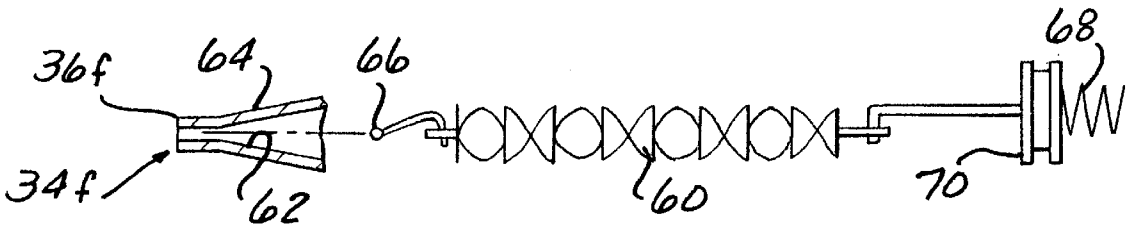
FIG. 13 is a detailed view of the tip seal valve and a mixer of round or rectangular peripheral cross section with a major portion of the nozzle housing removed for illustrative clarity.

Referring now to FIG. 13, the inner assembly of the tip seal valve and mixer element are shown outside of the mixer housing. As can be seen, the mixer element or assembly 60 has the piston member 70 connected at one end which is biased by spring 68 into a closed position with the valve member 66 engaging with the valve seat defined by the inner surface 62 of the conical tip 64. Movement of the piston 70 against the urging of the spring 68 cause the valve member 66 to retreat from the valve seat defined by the inner surface 62 of the conical tip 64 allowing material to discharge through the outlet port 34*f*.

Figure 14:
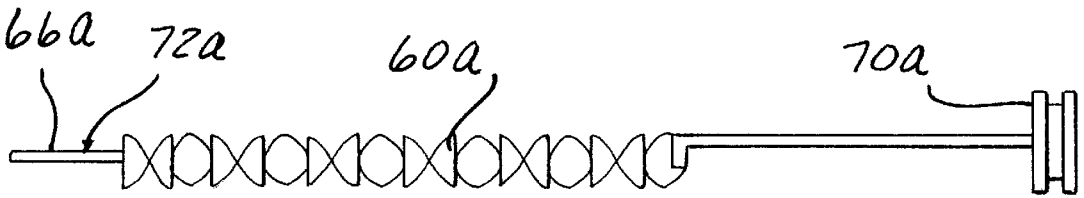
FIG. 14 is an alternative view of the tip seal valve and mixer assembly having a metal wire tip seal valve connected to the mixer body according to the present invention.

Referring now to FIG. 14, an alternative embodiment of the dispenser tip nozzle 56*a* is illustrated with the internal members of the dispenser tip nozzle 56*a* illustrated outside of the corresponding mixer housing for purposes of clarity. In this configuration, the piston 70*a* is also biased in the valve closed position by a spring (not shown). The piston is integrally formed or connected to the mixer element or assembly 60*a*. The mixer element or assembly 60*a* can be formed with a longitudinally extending metal wire tip 72 opposite from the piston 70*a*. The metal wire tip 72 defines the valve member 66*a* and is movable into sealing engagement with the inner surface 62 (shown in FIG. 13) of the conical tip 64 (shown in FIG. 13). Pressurized fluid can be used to move the piston 70*a* in opposition to the spring to withdraw the metal wire tip 72 from the seated position in order to allow material to exit through the material outlet port.

Figure 15:
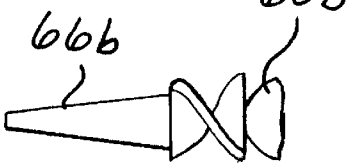
FIG. 15 is a detailed view of a molded tip seal valve on the end of the mixer body according to the present invention.

Referring now to FIG. 15, an alternative embodiment of the valve member 66*b* is illustrated. In the preferred configuration, the valve member 66*b* is integrally formed and molded with the mixer element or assembly 60*b*. The valve member 66*b* can be driven into sealing engagement with the inner surface 62 (shown in FIG. 13) of the conical tip 64 (shown in FIG. 13), and can be moved away from the valve seat against the urging of the spring by action of a compressed fluid with respect to the piston 70 (shown in FIG. 13).

Figure 16:
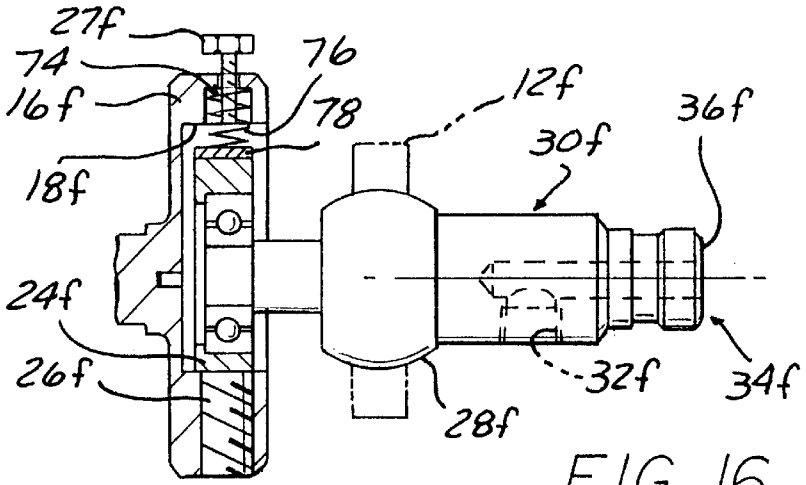
FIG. 16 is a simplified cross-sectional detailed view of the rotatable shaft or housing for converting rotation about an axis into circular orbital movement of a tip or nozzle with the nozzle in a centered rest position while not rotating.
Figure 18:
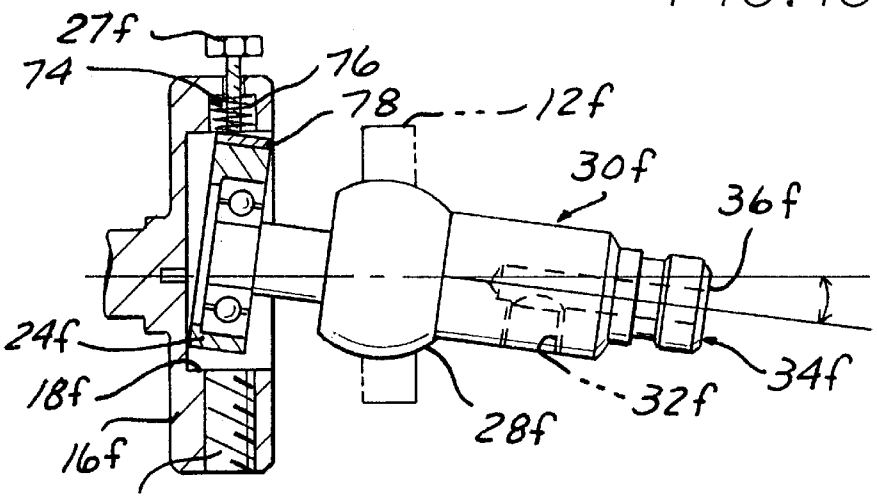
FIG. 18 is a simplified cross-sectional detailed view of the orbital applicator tool in an offset position in response to rotation according to the present invention.
Figure 17:
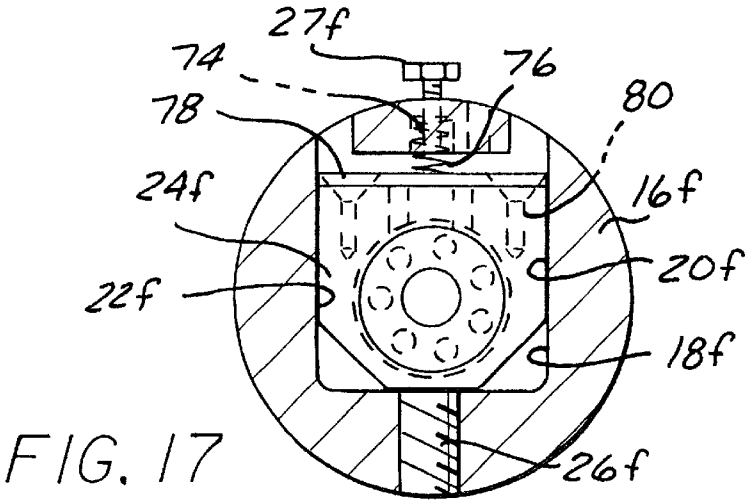
FIG. 17 is a cross-sectional view of the rotatable shaft or housing, slide element, biasing means, weighted plate, and adjusting means according to the present invention.
Figure 19:
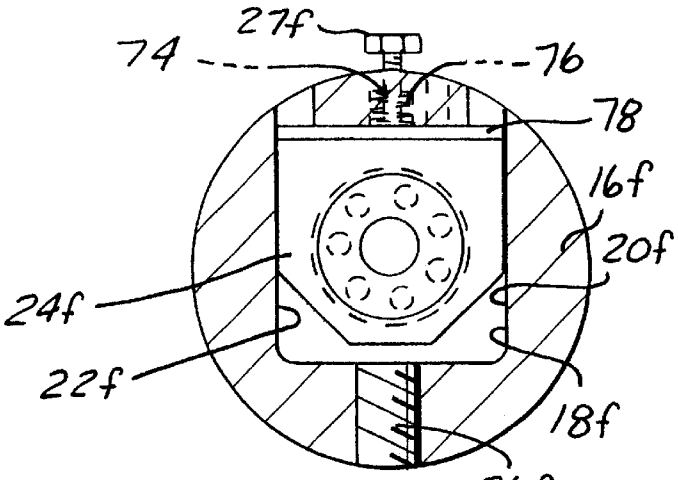
FIG. 19 is a cross-sectional view of the rotatable shaft or housing with the slide element in a displaced position in response to rotation of the shaft or housing according to the present invention.

Referring now to FIGS. 16–19, a preferred embodiment of the rotatable shaft 16*f* is illustrated. The rotatable shaft or housing 16*f* includes a slide pocket 18*f* having opposing side walls 20*f*, 22*f* extending radially and axially with respect to the axis of rotation. A movable plate 24*f* is slidably disposed within the pocket 18*f* for adjustable movement with respect to the axis of rotation of the rotatable shaft or housing 16*f*. The radial offset movement of the plate 24*f* preferably includes movement from a zero, null, or centered position (illustrated in FIGS. 16 and 17) where the axis of rotation of the rotatable shaft or housing 16*f* is coaxial with the longitudinal axis of the orbital element or member 30*f*, to a maximum radially offset position (illustrated in FIGS. 18 and 19) as defined by the maximum radial length of the slide pocket 18*f*. The plate 24*f* can be adjusted in its radial position within the slide pocket 18*f* of the rotatable shaft or housing 16*f* by adjustment screw 26*f*. The adjustment screw 26*f* can be used to fine tune the zero, null, or centered position of the orbital member 30*f* when the rotatable shaft or housing 16*f* is stationary. The plate 24*f* is movable off from the center line of the axis of rotation for the rotatable shaft or housing 16*f* in response to rotation of the rotatable shaft or element 16*f* about the axis of rotation. Preferably, the plate 24*f* is driven by centrifugal force in response to rotation of the housing 16*f*. A gauge plate 78 of predetermined dimension can be connected to the plate 24*f* by suitable fasteners 80 for adjusting an end limit of transverse movement of the slide plate or member 24*f* in response to rotational movement of the shaft 16*f*. A smaller dimension plate 78 can provide a greater transverse movement of the slide member or plate 24*f* resulting in a larger diameter orbital path for the opposite end of the elongate orbital member 30*f*. The desired diameter orbital path can be achieved by setting the position of an adjustable stop 27*f*, or a fixed hard stop, and the distance spaced from the part. Preferably the combination of the plate 24*f* and slide pocket 18*f* provide enough off center movement to achieve up to approximately ten degrees offset as illustrated in FIG. 18 while the encasement allows the bearing to self align with the center line of the shaft 30*f*. Biasing means 74 is provided for urging the slide member 24*f* toward the centered position when the shaft 16*f* is stationary as illustrated in FIGS. 16 and 17. The biasing means 74 can include a spring 76 engaged between the shaft 16*f* and the slide member 24*f* of sufficient strength to move the slide member 24*f* to the centered position when the shaft 16*f* is stationary with respect to the rotational axis.

The orbiting ball 28*f* is supported with respect to the base 12*f* for fixing a central point for movement of the orbital element or member 30*f*. The orbital ball connection 28*f* allows the orbital member 30*f* to sweep through orbital circular movements at opposite longitudinal ends of the orbital element or member 30*f* as one end of the orbital member or element 30*f* is driven by an attachment to the slidable plate 24*f* being rotated by the rotatable shaft or housing 16*f* and motor. At least one material inlet port 32*f* is provided along the longitudinal length of the orbital element or member 30*f*. The material passing through the orbital element or member 30*f* is discharged through at least one material outlet port 34*f*, such as through an attached nozzle, sprayer, streamer, or dispersing head 36*f*. A control valve can be provided for turning the supply of material to the outlet port on and off.

Figure 20A:
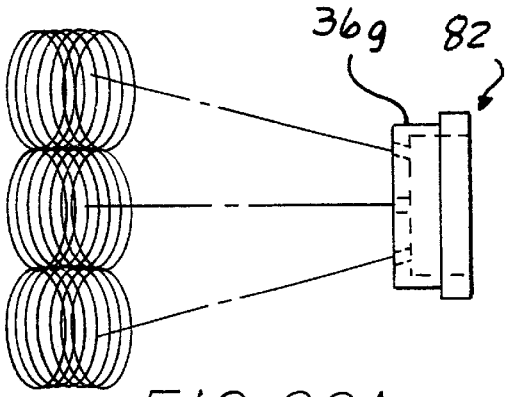
FIG. 20A is a side view of a first nozzle having three apertures for producing a stream pattern as illustrated to the left of FIG. 20A.
Figure 20B:
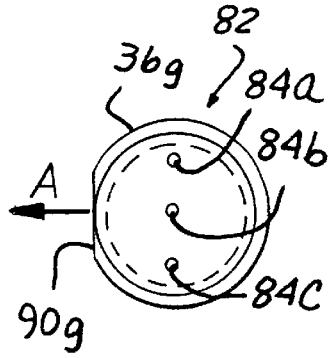
FIG. 20B is a front view of the nozzle of FIG. 20A.

Referring now to FIGS. 20A and 20B, a nozzle, sprayer, streamer, or a dispersing head 36*g* is illustrated. The present invention is well adapted to apply materials that can not be sprayed, or are difficult to spray. In the preferred configuration, the present invention provides a dispenser nozzle, sometimes referred to herein as a fluid nozzle, for streaming or dispensing a fluid to be applied to a workpiece. Streaming, or dispensing, a fluid with the present invention can reduce or eliminate the difficulties associated with spraying, such as fogging and overspray. The fluid nozzle 36*g* applies a fluid material selected from a group consisting of a sealant material, an adhesive material, and a noise attenuation material. Means 82 is provided for adjusting a dispersal pattern of the fluid material by, for example, exchanging the fluid nozzle 36*g* illustrated in FIG. 20A and 20B with fluid nozzle 36*h*, 36*i*, 36*j* or 36*k* illustrated in FIGS. 21A through 21B, 22A through 22B, 23A through 23B, and 24A through 24B respectively. In FIGS. 20A and 20B, the fluid nozzle 36*g* includes a plurality of apertures 84*a*, 84*b*, 84*c* which can be identical to one another. Alternatively, the plurality of apertures can be machined at an angle with respect to a center of the nozzle 36*g* as best seen in FIG. 20A. One of the plurality of apertures can be a central aperture 84*b* in the fluid nozzle 36*g*. Each of the nozzles can include an orientation surface 90*g*, 90*h*, 90*i* or 90*j* to orient the nozzles in a known, predetermined position for controlling the dispersal pattern of the fluid material while the nozzle is moved along a predetermined path indicated by arrow A. As can be seen from FIG. 20A, the nozzle configuration of fluid nozzle 36*g* provides a widely dispersed pattern when moved from left to right as viewed in the drawing, while being capable of providing a heavier application of fluid material in a less dispersed pattern when moved along a path extending from top to bottom of the Figure as illustrated.

Figure 21A:
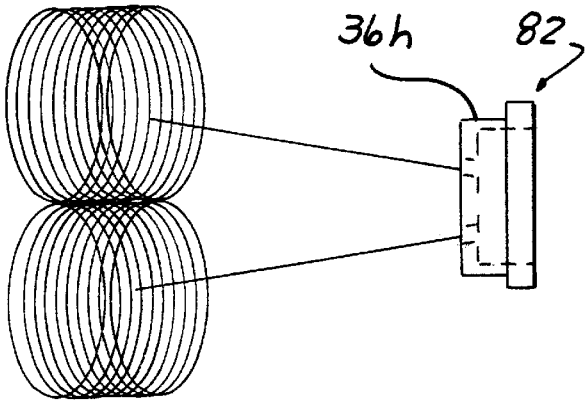
FIG. 21A is a schematic side elevational view of a second nozzle having four apertures for producing the dispersion pattern shown schematically to the left of FIG. 21A according to the present invention.
Figure 21B:
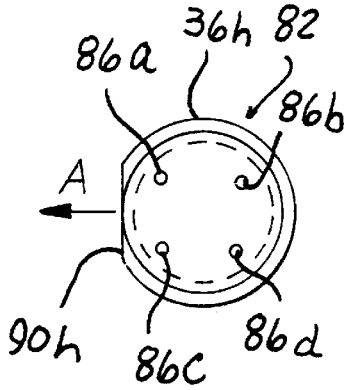
FIG. 21B is a front view of the nozzle illustrated in FIG. 21A.

Referring now to FIGS. 21A and 21B, an alternative nozzle configuration for the fluid nozzle 36*h* is depicted. The fluid nozzle 36*h* provides means for adjusting a dispersal pattern of the fluid material by being interchangeable with the nozzle illustrated in FIGS. 20A, 20B, FIGS. 22A, 22B, FIGS. 23A, 23B, or FIGS. 24A, 24B. The fluid nozzle 36*h* includes an orientation surface 90*h* to insure that the fluid nozzle is installed in a known orientation and position for control of the dispersal pattern of fluid material to be applied. As can best be seen in FIG. 21A, the dispersal pattern provided with nozzle 36*h* is widely dispersed and provides a consistent pattern of dispersal in both the left to right path of travel as well as the top to bottom path of travel when viewed as illustrated in the Figures. The fluid nozzle 36*h* includes a plurality of apertures 86*a*, 86*b*, 86*c*, 86*d* formed in the face of the fluid nozzle 36*h* at equally spaced angular positions with respect to one another. The plurality of apertures 86*a*, 86*b*, 86*c*, 86*d* are preferably identical to one another. The plurality of apertures 86*a*, 86*b*, 86*c*, 86*d* can be machined at an angle with respect to a center of the fluid nozzle 36*h*. The pitch, number of circles per inch, is dependant on the speed, and number of inline apertures in the nozzle, and the distance between the apertures, i.e. six apertures would produce a tighter pitch at the same speed, or the same pitch as two apertures at a slower surface speed or orbit speed. Variations in the number of apertures and the spacing give enormous flexibility in pattern selection.

Figure 22A:
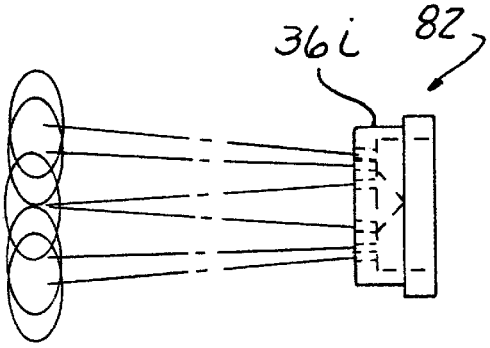
FIG. 22A is a simplified side elevational view of a nozzle having six apertures according to the present invention for producing the dispersal pattern shown to the left of FIG. 22A.
Figure 22B:
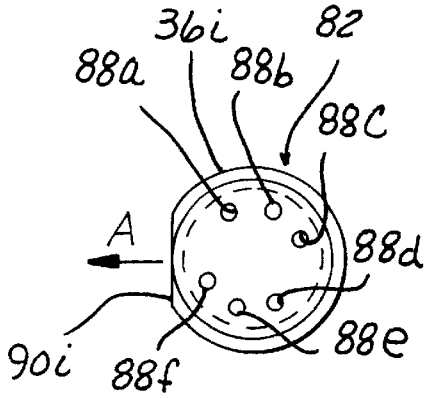
FIG. 22B is a front view of the nozzle illustrated in FIG. 22A.

Referring now to FIGS. 22A and 22B, another alternative fluid nozzle 36*i* is depicted providing means 82 for adjusting a dispersal pattern of the fluid material to be applied. The fluid nozzle 36*i* includes an orientation surface 90*i* for aligning the fluid nozzle in a known, predetermined orientation when installed so that the dispersion pattern of the fluid material to be applied can be accurately controlled. The fluid nozzle 36*i* can include a plurality of apertures 88*a*, 88*b*, 88*c*, 88*d*, 88*e*, 88*f* formed through the face of the fluid nozzle

36*i* at spaced angular positions with respect to one another. Preferably, the plurality of apertures 88*a*, 88*b*, 88*c*, 88*d*, 88*e*, 88*f* are formed identical to one another. The plurality of apertures can be machined at an angle with respect to a center of the fluid nozzle 36*i* to form the desired pattern at a predetermined distance from the workpiece to which the fluid material is to be applied. The aperture pattern in the fluid nozzle 36*i* provides a dispersal pattern of the fluid material as illustrated to the left of FIG. 22A.

The three aperture fluid nozzle 36*g* can provide a large, smooth or ridged pattern with light or heavy coverage. The gaps in the pattern can be closed or open depending on the product specifications. The apertures in the insert are machined at specified angles, so that the distance from the part, revolution per minute of the motor, material pressure, throw of the swirl tool, and specified angles of the apertures in the fluid nozzle all contribute to the overall size of the pattern. When the tool is moved in a first direction, the dispersal pattern from each aperture are spaced from one another to provide a wide dispersal pattern. When the tool is moved in a direction normal to the first direction, the dispersal pattern from the three apertures align over top of one another to produce a more compact concentrated application of fluid to the workpiece.

The four-aperture fluid nozzle 36*h* can provide a large, smooth or ridged pattern with light or heavy coverage. The pattern is the same when moving in either an X or Y direction perpendicular to one another creating a bi-directional application nozzle. The gaps in the pattern can be closed or open depending on the product specifications. The apertures are machined in the fluid nozzle at specified angles where the distance from the part, revolution per minute of the motor, material pressure, throw of the swirl tool, and specified angle of the apertures in the fluid nozzle all contribute to the overall size of the pattern.

The six aperture fluid nozzle 36*i* can provide a large, smooth or ridged pattern with light or heavy coverage. The gaps in the pattern can be closed or open depending on the product specifications. The apertures in the fluid nozzle are machined at specified angles, where the distance form the part, revolution per minute of the motor, material pressure, throw of the swirl tool, and specified angle of apertures in the fluid nozzle all contribute to the overall size of the pattern illustrated in FIG. 22A.

Figure 23A:
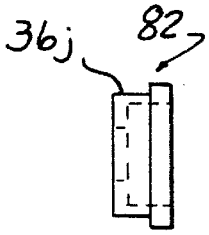
FIG. 23A is a simplified side elevational view of a nozzle having two elongated apertures according to the present invention for producing a heavy dispersal pattern.
Figure 23B:
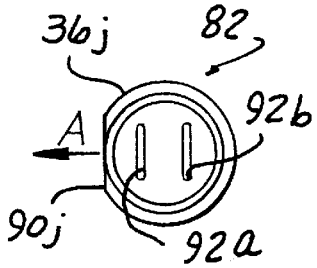
FIG. 23B is a front view of the nozzle illustrated in FIG. 23A.
Figure 25:
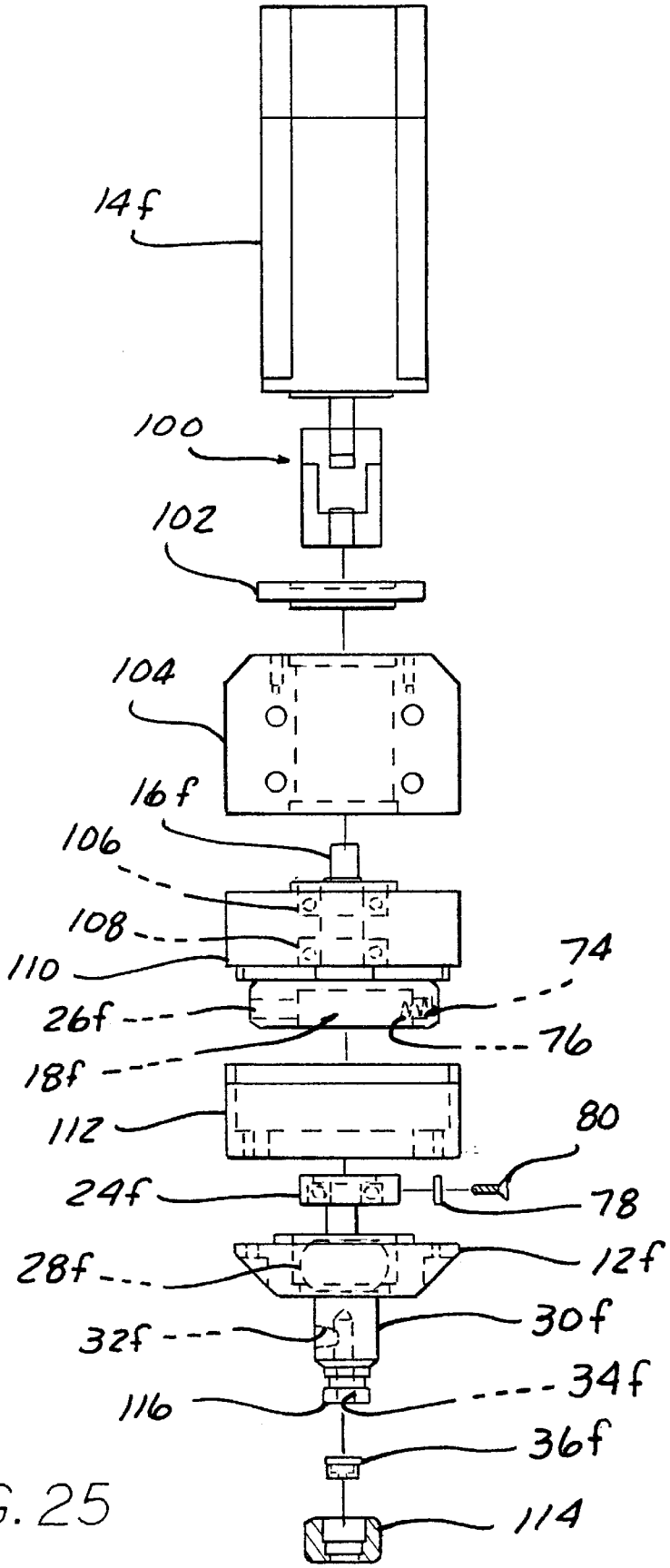
FIG. 25 is an exploded view of an orbital applicator tool according to the present invention with in-line drive motor.

Referring now to FIGS. 23A and 23B, an alternative configuration for the fluid nozzle 36*j* is depicted. The fluid nozzle 36*j* provides means for adjusting a dispersal pattern of the fluid material by being interchangeable with the nozzles 36*g*, 36*h*, or 36*i*. The fluid nozzles 36*g*, 36*h*, 36*i*, 36*j*, can be formed as replaceable pattern inserts held in place by an insert retaining tip as best seen in FIG. 25. The fluid nozzles or inserts 36*g*, 36*h*, 36*i*, 36*j* include an orientation surface 90*g*, 90*h*, 90*i*, 90*j* to insure that the fluid nozzles or inserts are installed in a known orientation and positioned for control of the dispersal pattern of fluid material to be applied. The fluid nozzle 36*j* includes a plurality of apertures 92*a*, 92*b* formed in the face of the fluid nozzle 36*j*. Preferably, the apertures 92*a*, 92*b* are elongated in length and are spaced equally from a center of the fluid nozzle 36*j*. The plurality of apertures 92*a*, 92*b* are preferably identical to one another. If desired, the sidewalls defining the apertures 92*a*, 92*b* can be machined at an angle with respect to a center of the fluid nozzle 36*j*.

Figure 24A:
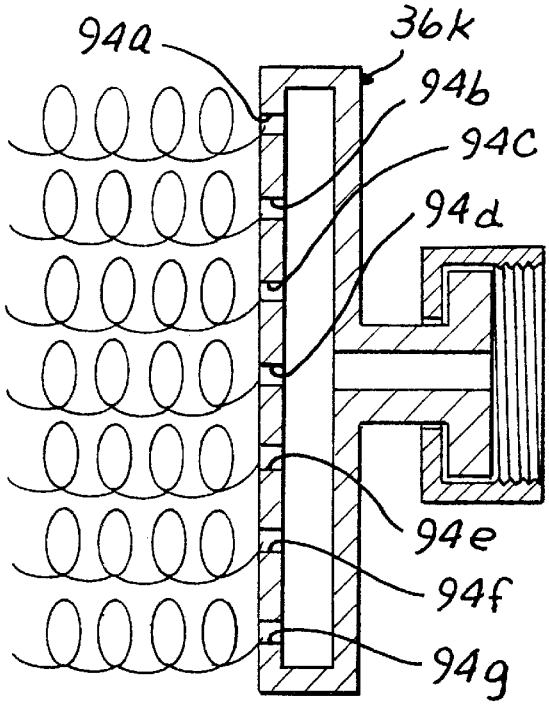
FIG. 24A is a simplified side elevational view of a nozzle having an elongate dimension with a plurality of apertures according to the present invention to produce a wide dispersal swirl pattern.
Figure 24B:
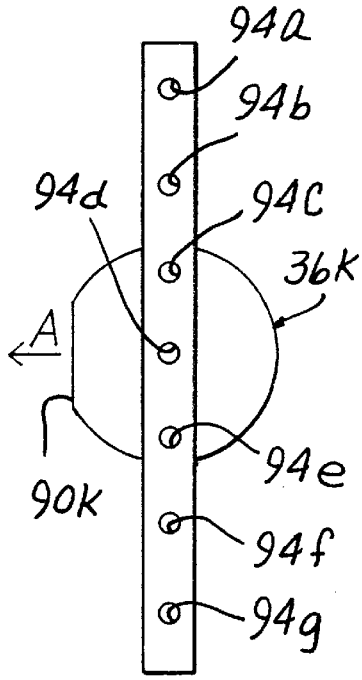
FIG. 24B is a front view of the nozzle illustrated in FIG. 24A.

Referring now to FIGS. 24A and 24B, an alternative configuration for the fluid nozzle 36*k* is depicted. The fluid nozzle 36*k* provides means for adjusting a dispersal pattern of the fluid material by being interchangeable with the nozzles 36*g*, 36*h*, 36*i*, or 36*j*. The fluid nozzles can be formed as replaceable pattern inserts held in place by a threaded collar best seen in FIG. 24A. The fluid nozzles or inserts can include an orientation surface to insure that the fluid nozzles or inserts are installed in a known orientation and position for control of the dispersal pattern of fluid material to be applied, such as while the nozzle is moved along a predetermined path as indicated by arrow A. The fluid nozzle 36*k* includes a plurality of apertures 94*a*, 94*b*, 94*c*, 94*d*, 94*e*, 94*f*, and 94*g* formed on the face of the fluid nozzle 36*k*. Preferably, the apertures 94*a*–94*g* are identical to one another. The plurality of apertures can be machined at an angle with respect to a center line of the elongate body of the fluid nozzle 36*k* to form the desired pattern at a predetermined distance from the workpiece to which the fluid material is to be applied. The aperture pattern in the fluid nozzle 36*k* provides a dispersal pattern of the fluid material generally as illustrated to the left of FIG. 24A.

Referring now to FIG. 25, an alternative configuration is illustrated with an in-line prime rotary device 14*f*, which can take the form of a servo motor, pneumatic motor, hydraulic motor, or stepper motor. The prime rotary device 14*f* is connected by a coupler 100 to the rotatable shaft or spindle 16*f*. The coupler 100 can be in the form of a two-piece jaw coupler. Preferably, a heat shield 102 is interposed between the prime rotary device 14*f* and the coupler housing 104. The heat shield 102 can be formed of a phenolic material. The spindle or shaft 16*f* is supported by radial bearings 106, 108 positioned within a bearing housing 110. The spindle or shaft 16*f* includes an enlarged portion with a slide pocket 18*f* having opposing sidewalls extending radially and axially with respect to the axis of rotation.

A throw plate or bearing plate 24*f* is positionable within the slide pocket 18*f* for adjustable movement with respect to the axis of rotation of the rotatable shaft or spindle 16*f*. The radial offset of the throw plate or bearing plate 24*f* can include movement from a zero, null, or centered position, where the axis of rotation of the elongate orbital member 30*f* connected to the throw plate or bearing plate 24*f* is coaxial with the axis of rotation of the spindle or shaft 16*f*, and permits radially offset movement to a maximum distance defined by a length of the slide pocket 18*f*, or an adjustable outer stop (not shown). The throw plate or bearing plate 24*f* can be adjusted with respect to a radial position within the slide pocket 18*f* of the rotatable shaft or spindle 16*f* by adjustment screw 26*f*. The throw plate or bearing plate 24*f* is typically moveable up to approximately 10° (degrees) off center as measured between the rotational axis of the shaft 16*f* and the rotational axis of the orbital element 30*f* where the shaft 16*f* and member 30*f* intersect at the center of the orbital ball connection 28*f*. If required for a particular application, a wider slide pocket can be provided for adjusting up to approximately 90° (degrees) off center as measured between the rotational axis of the shaft 16*f* and the rotational axis of the orbital element 30*f* where the shaft 16*f* and member 30*f* intersect at the center of the orbital ball connection 28*f*.

Biasing means 74 is provided for urging the throw plate or bearing plate 24*f* toward the centered position when the shaft 16*f* is stationary or non-rotating. The biasing means 74 can include a spring 76 engaged between the shaft 16*f* and the throw plate or bearing plate 24*f* of sufficient strength to move the throw plate or bearing plate 24*f* to the centered position when the shaft 16*f* is stationary or non-rotating with respect to the rotational axis. An interchangeable throw adjustment plate 78 can be connected to the throw plate or bearing plate 24*f* by suitable fasteners 80 for adjusting an amount of transverse movement of the throw plate or bearing plate 24*f* in response to rotational movement of the shaft 16*f*. The enlarged portion of the shaft or spindle 16*f* including the slide pocket 18*f* and throw plate or bearing plate 24*f* can be enclosed within a spindle housing 112.

The orbiting ball 28*f* is supported with respect to the base 12*f* for fixing a central point of movement of the orbital element or member 30*f*. The base 12*f* can include a spherical bearing retainer or collar. The orbital ball connection 28*f* allows the orbital member 30*f* to sweep through orbital circular movements at opposite longitudinal ends of the orbital element or member 30*f* as one end of the orbital member or element 30*f* is driven by an attachment to the throw plate or bearing plate 24*f* while the throw plate or bearing plate 24*f* is being rotated by the rotatable shaft or spindle 16*f* and associated prime rotary device 14*f*.

At least one material inlet port 32*f* is provided along the longitudinal length of the orbital element or member 30*f*. The material passing through the orbital element or member 30*f* is discharged through at least one material outlet port 34*f*, which can include a replaceable pattern insert or nozzle 36*f* and insert retainer or tip 114. The nose portion of the orbital element or member 30*f* can include a tab 116 to hold the insert 36*f* in a desired orientation.

Figure 26:
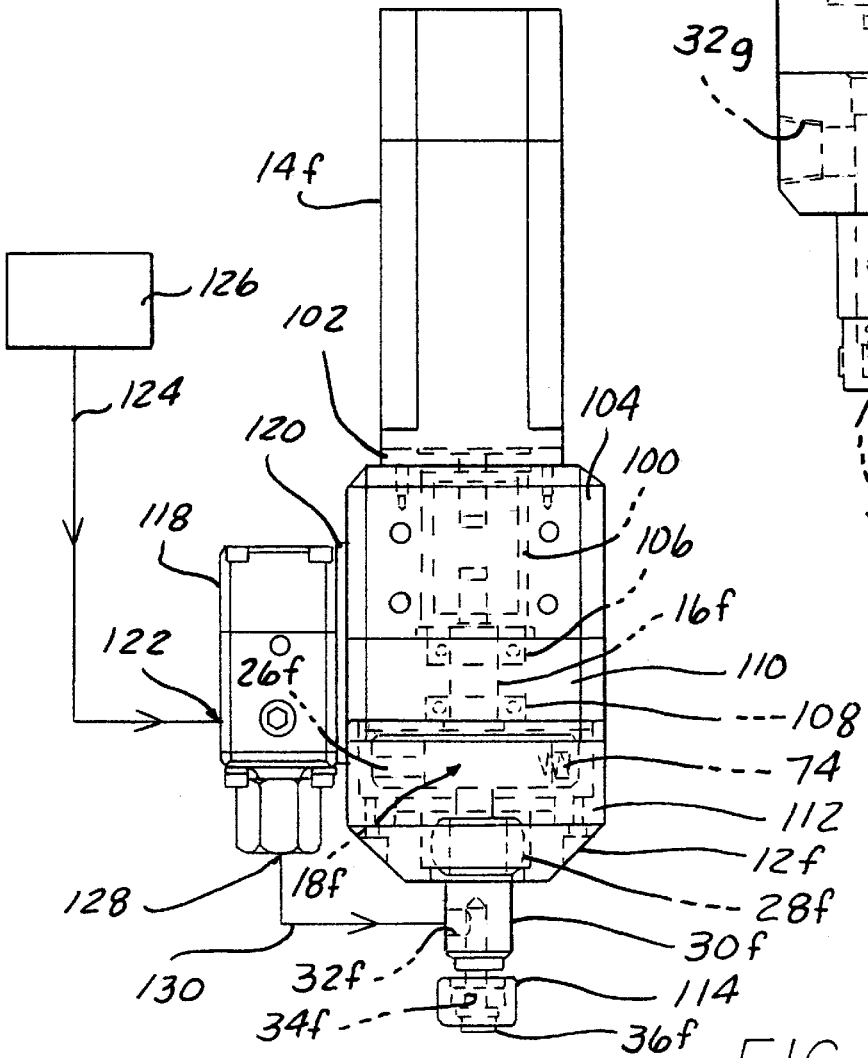
FIG. 26 is a schematic view of a positive displacement meter pump for supplying fluid material to be applied through a dispense valve to the orbital applicator tool according to the present invention.

Referring now to FIG. 26, the orbital applicator tool previously shown in an exploded view in FIG. 25 is shown in an assembled view. Details of the orbital element and converting means can be seen as shown in the detailed view of FIGS. 16–19. FIG. 26 also includes a dispense control valve 118. If desired, the dispense control valve 118 can be mounted to the coupler housing 104 and/or bearing housing 110 and/or spindle housing 112. A vibration dampening gasket 120 can be disposed between the dispense control valve 118 and one or more of the coupler housing 104, bearing housing 110, and spindle housing 112. The dispense control valve 118 includes an inlet 122 for receiving fluid material through a material supply conduit or hose 124. The material conduit or supply hose 124 can include an optional heating or cooling system. The material supply hose or conduit 124 connects at an opposite end to a positive displacement meter pump 126. The positive displacement meter pump 126 provides a consistent dispersal pattern with no pulses or fluctuations through the fluid nozzle 34*f*. The dispense control valve 118 includes at least one outlet 128 connected by an appropriate material dispense hose or conduit 130 to the inlet port 32*f* of the orbital element or member 30*f*.

Figure 27:
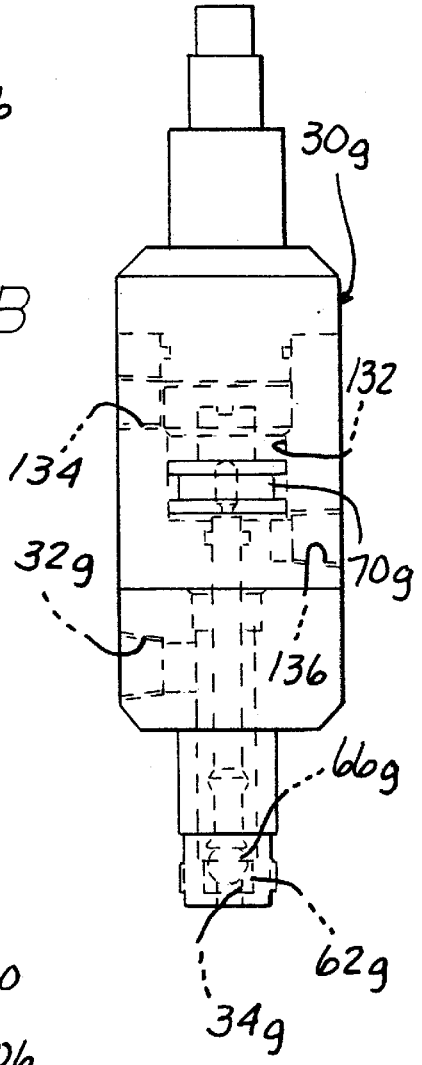
FIG. 27 illustrates a replacement nose for the orbital applicator tool with tip seal valve according to the present invention.

Referring now to FIG. 27, an alternative embodiment of an orbital element or member 30*g* is depicted with a tip seal material cutoff valve. The orbital element or member 30*g* includes at least one material inlet port 32*g* and at least one material outlet port 34*g*. An inner surface 62*g* of the material conduit defines a valve seat for engagement with a valve member 66*g* formed of any suitable material composition and shape for the particular application. By way of example and not limitation, the valve member 66*g* can be in the form of a spherical member moveable longitudinally within the material conduit of the orbital element or member 30*g* to move the valve member 66*g* from a closed or off position in sealing engagement with the inner surface 62*g* to a spaced or open position allowing material to flow out of the at least one material outlet port 34*g*. Attached to an opposite end of the valve member 66*g* is a piston 70*g* moveable between first and second end limits of travel within a chamber 132 having a first fluid port 134 communicating with the chamber 132 on one side of the piston 70*g* and a second fluid port 136 communicating with a portion of a chamber 132 on an opposite side of the piston 70*g*. A source of pressurized fluid, such as compressed air, or hydraulic fluid, is provided to either side of the piston 70*g* to move the piston 70*g* and an associated valve member 66*g* between the first and second end limits of travel within the chamber 132 corresponding to the open and closed positions of the valve 66*g* with respect to the inner surface 62*g* of the valve seat.

Figure 28:
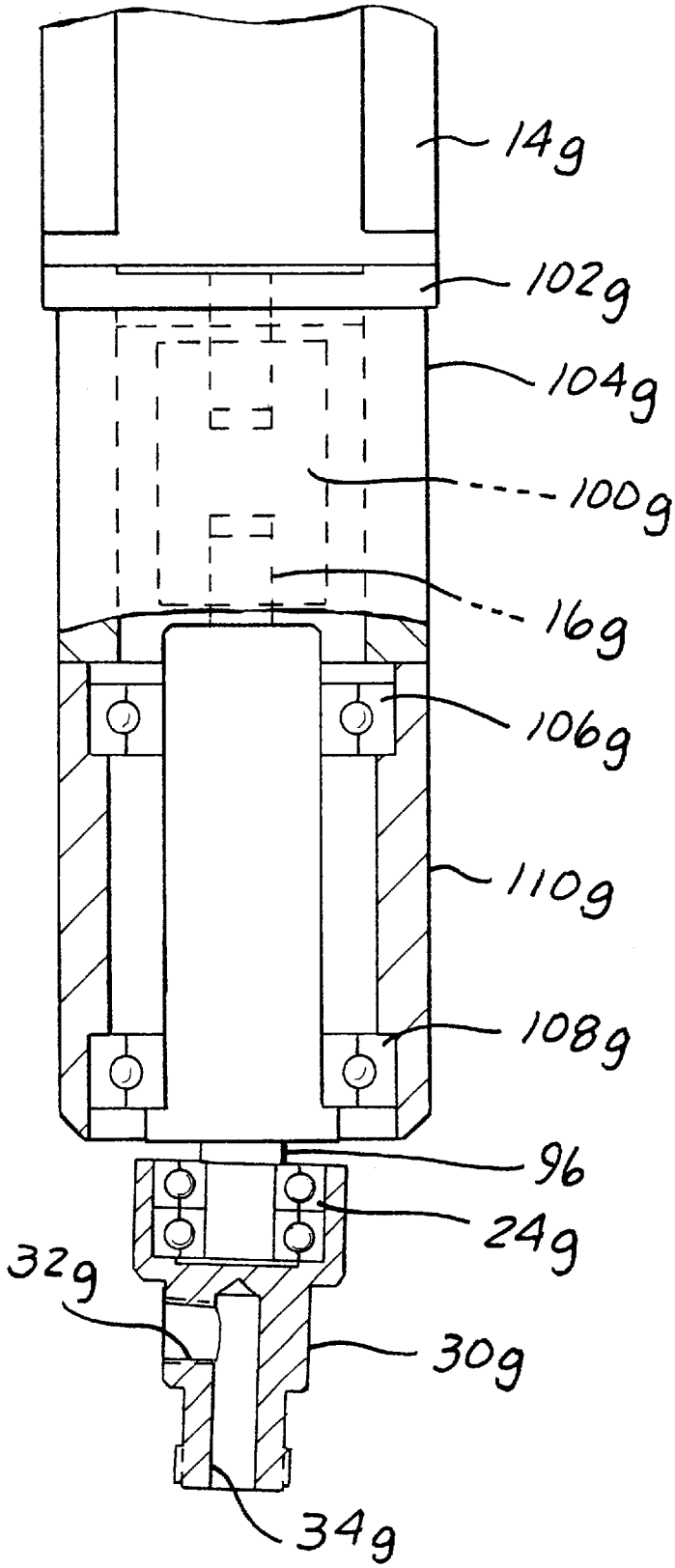
FIG. 28 is a simplified orbital applicator tool according to the present invention with a bent shaft to produce a predetermined swirl action.

Referring now to FIG. 28, an alternative configuration is illustrated with an in-line prime rotary device 14*g*, which can take the form of a servo motor, pneumatic motor, hydraulic motor, or stepper motor. The prime rotary device 14*g* is connected by a coupler 100*g* to the rotatable shaft or spindle 16*g*. The coupler 100*g* can be in the form of a two-piece jaw coupler. Preferably, a heat shield 102*g* is interposed between the prime rotary device 14*g* and the coupler housing 104*g*. The heat shield 102*g* can be formed of a phenolic material. The spindle or shaft 16*g* is supported by radial bearings 106*g*, 108*g* positioned within a bearing housing 110*g*. The shaft 16*g* exits the housing 110*g* and includes a bent or angled portion 96 to create an orbiting path or wobble to the outer end of the shaft 116 as it rotates. An elongate orbital member 30*g* is connected to the outer end of the angled portion 96 of shaft 16*g*. One or more bearings 24*g* are connected between the outer end of the bent portion 96 of shaft 16*g* and the elongate orbital member 30*g*. The bearings 24*g* permit the orbital member 30*g* to swirl about an axis, while not rotating in order to prevent tangling of fluid lines connected to at least one material inlet port 32*g* provided along the longitudinal length of the orbital element or member 30*g*. The material passing through the orbital element or member 30*g* is discharged through at least one material outlet port 34*g*, which can include a replaceable pattern insert or nozzle and insert retainer or tip. The nose portion of the orbital element or member 30*g* can include a tab to hold the insert in a desired orientation.

Figure 29:
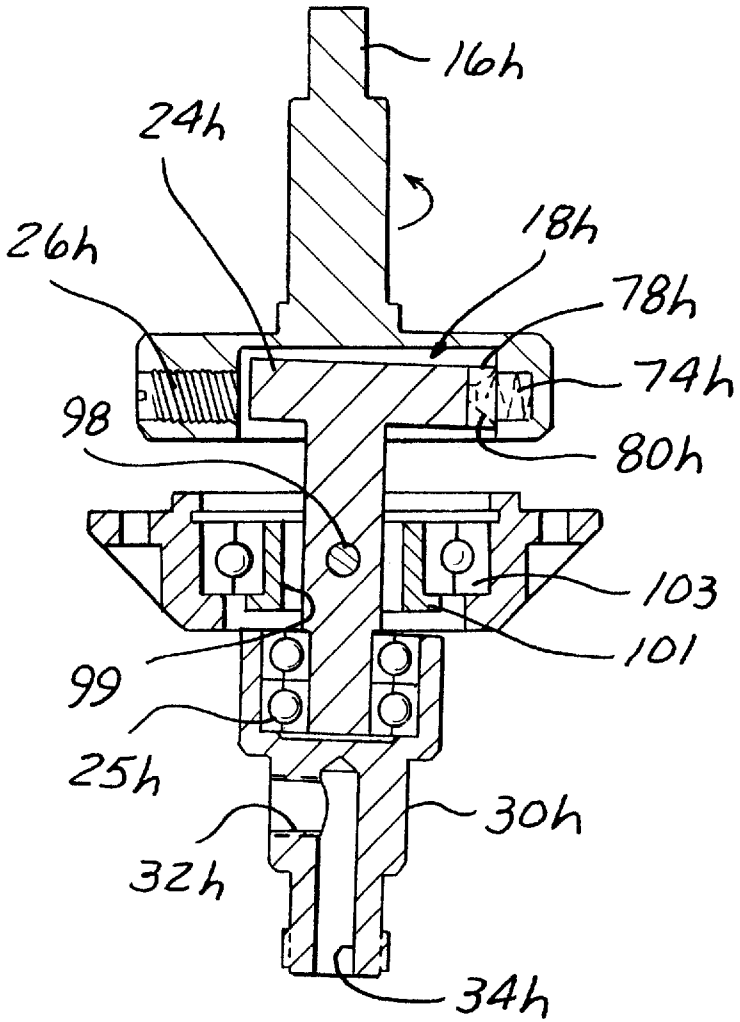
FIG. 29 is a simplified cross-sectional detailed view of a rotatable shaft or housing for converting rotation about an axis into circular orbital movement of a tip or nozzle in an offset position where the tip or nozzle shaft is rotatable about a pivot pin according to the present invention.

Referring now to FIG. 29, the rotatable shaft or housing 16*h* includes a slide pocket 18*h* having opposing sidewalls extending radially and axially with respect to the axis of rotation. A movable plate 24*h* is slidably disposed within the pocket 18*h* for adjustable movement with respect to the axis of rotation of the rotatable shaft or housing 16*h*. The radial offset movement of the plate 24*h* preferably includes movement from a zero, null, or centered position where the axis of rotation of the rotatable shaft or housing 16*h* is coaxial with the longitudinal axis of the orbital element or member 30*h* to a maximum radially offset position shown in FIG. 29 as defined by the maximum radially length of the slide pocket 18*h*. The plate 24*h* can be adjusted in its radial position within the slide pocket 18*h* of the rotatable shaft or housing 16*h* by adjustment screw 26*h*. The adjustment screw 26*h* can be used to fine tune the zero, null, or centered position of the orbital member 30*h* when the rotatable shaft or housing 16*h* is stationary. Alternatively, the adjustment screw 26*h* can be used to drive the plate 24*h* permanently against the opposing wall of the slide pocket 18*h* to retain the orbital member 30*h* in a predetermined angular orientation with respect to the axis of rotation of the shaft 16*h*. The plate 24*h* is moveable off from the center line of the axis of rotation of the rotatable shaft or housing 16*h* in response to either adjustment of the screw 26*h*, or rotation of the rotatable shaft or element 16*h* about the axis of rotation. If self centering operation is desired, the plate is driven by centrifugal force in response to rotation of the housing 16*h*. A gauge plate 78 of predetermined dimension can be connected to the plate 24*h* by suitable fasteners 80*h* for adjusting an end limit of transverse movement of the slide plate member 24*h* in response to rotation movement of the shaft 16*h*. A smaller dimension plate 78*h* can provide a greater transverse movement of the slide plate 24*h* resulting in a larger diameter orbital path for the opposite end of the elongate orbital member 30*h*. The desired diameter path can be achieved by setting the position of an adjustable stop 27*h*, or a fixed hard stop, or the distance spaced from the part. Preferably the combination of the plate 24*h* and slide pocket 18*h* provide enough off center movement to achieve up to approximately 10° offset with respect to the center line or axis of rotation of the shaft 16*h*. It should be understood that off center adjustment greater than 10° can be provided if desired for a particular application. As the plate 24*h* is moved off center with respect to the slide pocket 18*h*, the center line of the orbital member 30*h* is pivoted about pivot pin 98. Pivot pin 98 is mounted within an enlarged aperture 99 extending through a rotatable member 101 supported by one or more bearings 103. The outer end of the slide plate or member 24*h* opposite from the slide pocket 18*h* with respect to the pivot pin 98 supports one or more bearings 25*h* for mounting the orbital member 30*h*. The elongate orbital member 30*h* is mounted through bearings 25*h* in order to allow the orbital member 30*h* to sweep through the orbital path without rotating to prevent tangling of conduits connected to at least one inlet port 32*h* for the fluid material to be applied. The material passing through the orbital element or member 30*h* is discharged through at least one material outlet port 34*h*, such as through an attached nozzle, sprayer, streamer or dispersing head. The slide plate or member 24*h* can be biased toward the zero, null, or centered position with biasing means 74*h*. As an alternative to the replaceable gauge plate 78*h*, a set screw similar to that illustrated in FIGS. 16–19 can be provided for adjusting the outer end limit of travel of the slide plate 24*h*.

Figure 30:
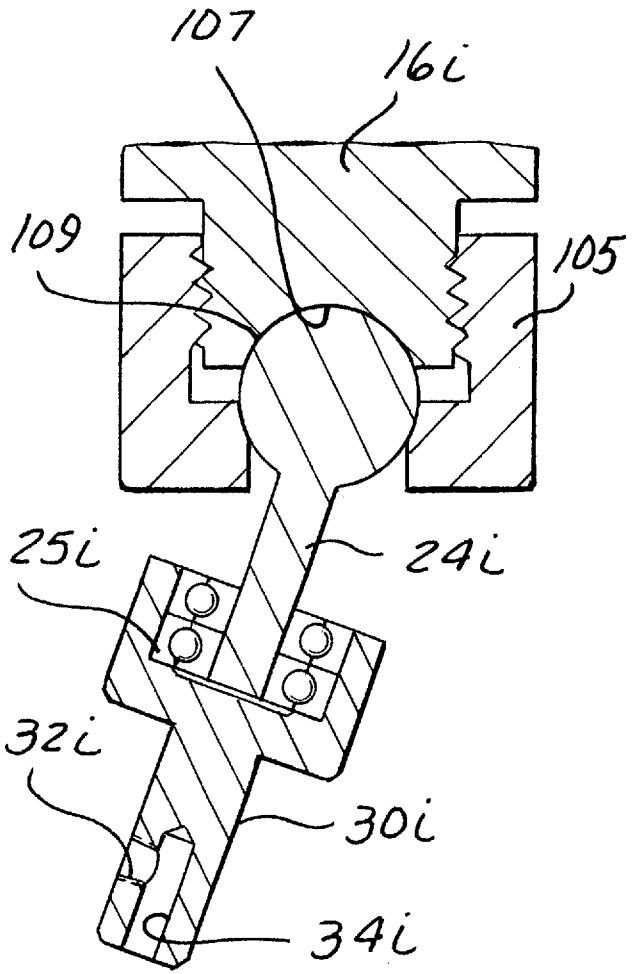
FIG. 30 is a simplified cross-sectional detailed view of the rotatable shaft or housing for converting rotation about an axis into circular orbital movement of a tip or nozzle with a screwed connection having a ball and socket joint for adjustably setting the angular offset of the tip or nozzle shaft with respect to the rotatable shaft.

Referring now to FIG. 30, an alternative embodiment of the rotatable shaft 16*i* is illustrated. The outer end of the rotatable shaft 16*i* can include a threaded portion for operable engagement with a threaded retaining cap 105. The threaded retaining cap can operably secure complementary surfaces 107, 109 formed between the shaft 16*i* and offset member 24*i*. The complementary surfaces 107, 109 can be any desired configuration allowing incremental or infinite adjustment of angular offset with respect to the axis of rotation of the rotatable shaft 16*i*. For purposes of illustration, and not limitation, the complementary surfaces 107, 109 are shown as a ball and socket configuration allowing infinite incremental adjustment for angular offset between the rotational axis of the shaft 16*i* and the longitudinal axis of the offset member 24*i*. The outer end of the offset member 24*i* supports one or more bearings 25*i* for connection of the orbital member 30*i*. The bearings 25*i* allow the orbital member 35*i* to be connected to the offset member 24*i* in order to sweep through the orbital path, without rotating in order to allow connection of one or more conduits to at least one inlet port 32*i*. The material entering through inlet port 32*i* passes through the orbital element or member 30*i* to be discharged through at least one material outlet 34*i*, such as through an attached nozzle, sprayer, streamer, or dispersing head. As with any of these configurations, a control valve can be provided for turning the supply of material to the outlet port on and off.

Figure 31:
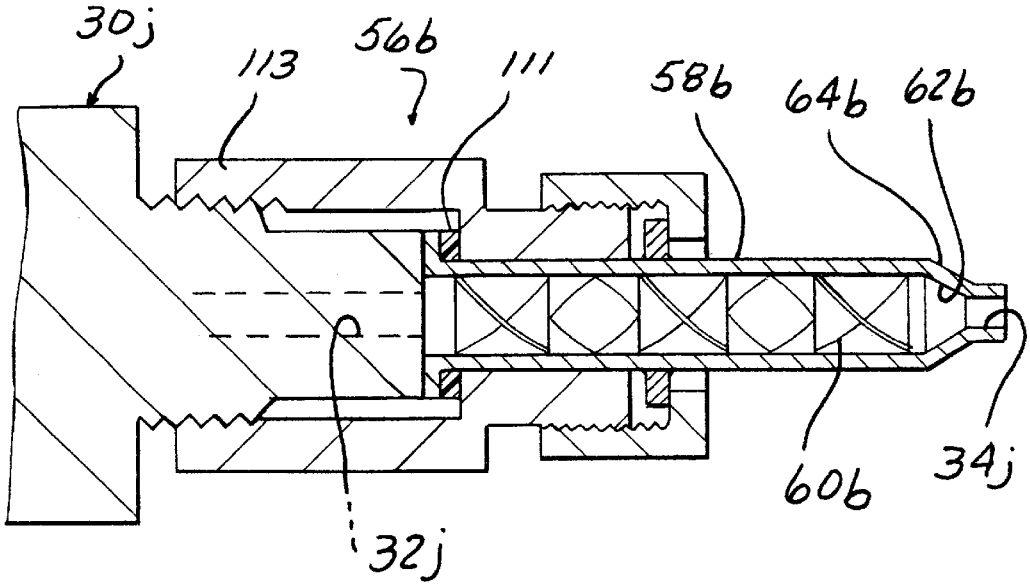
FIG. 31 is a metal streaming nozzle usable in combination with a static mixer and/or tip seal configuration according to the present invention.

Referring now to FIG. 31, an alternative embodiment of the dispenser tip nozzle 56*b* is illustrated according to the present invention. The dispenser tip nozzle 56*b* can include at least one material inlet port 32*j* and at least one material outlet port 34*j*. Preferably, the dispenser tip nozzle 56*b* includes a mixer housing 58*b* enclosing a mixer element or assembly 60*b* for thoroughly mixing a two part material with respect to one another prior to discharge through the at least one material outlet port 34*j*. The mixer housing 58*b* receives the material from the at least one material inlet port 32*j* in communication with one end of the mixer housing 58*b*. An opposite end of the mixer housing 58*b* includes at least one material outlet port 34*j* for discharging the material. Preferably, the at least one outlet port 34*j* is defined by the mixer housing 58*b* tapering conically to a tip formed from either the same material as the mixer housing 58*b*, or as an insert composed of a suitable material. In the preferred configuration, the housing and conically tapered tip are formed of steel. The inner surface 62*b* of the conical tip 64*b* can define a valve seat if desired for engagement with a valve member (not shown) formed of any suitable material composition and shape for the particular application similar to that illustrated and described with respect to FIGS. 12–15. By way of example and not limitation, the valve member can be in the form of a spherical member, partial spherical member, tapered cone, or wire plug connected to or integrally formed with the mixer element or assembly 60*b*. In either case, with or without a valve member, the steel streaming nozzle 64*b* provides an orifice 34*j* of predetermined dimension to meet the application requirements of the stream of material to be applied. The steel housing 58*b* can be sealed with a gasket 111 for connecting to the orbital member 30*j* or other applicator tool. The mixer element or assembly 60*b* is preferably formed of disposable plastic material. Preferably, the at least one inlet port 32*j* includes first and second inlet ports connected to dual spool valves for controlling the entry of a two part mixture into the mixing chamber. The gasket or seal 111 is compressed between the steel mixer housing 58*b* and a threaded retainer assembly 113.

Figure 32:
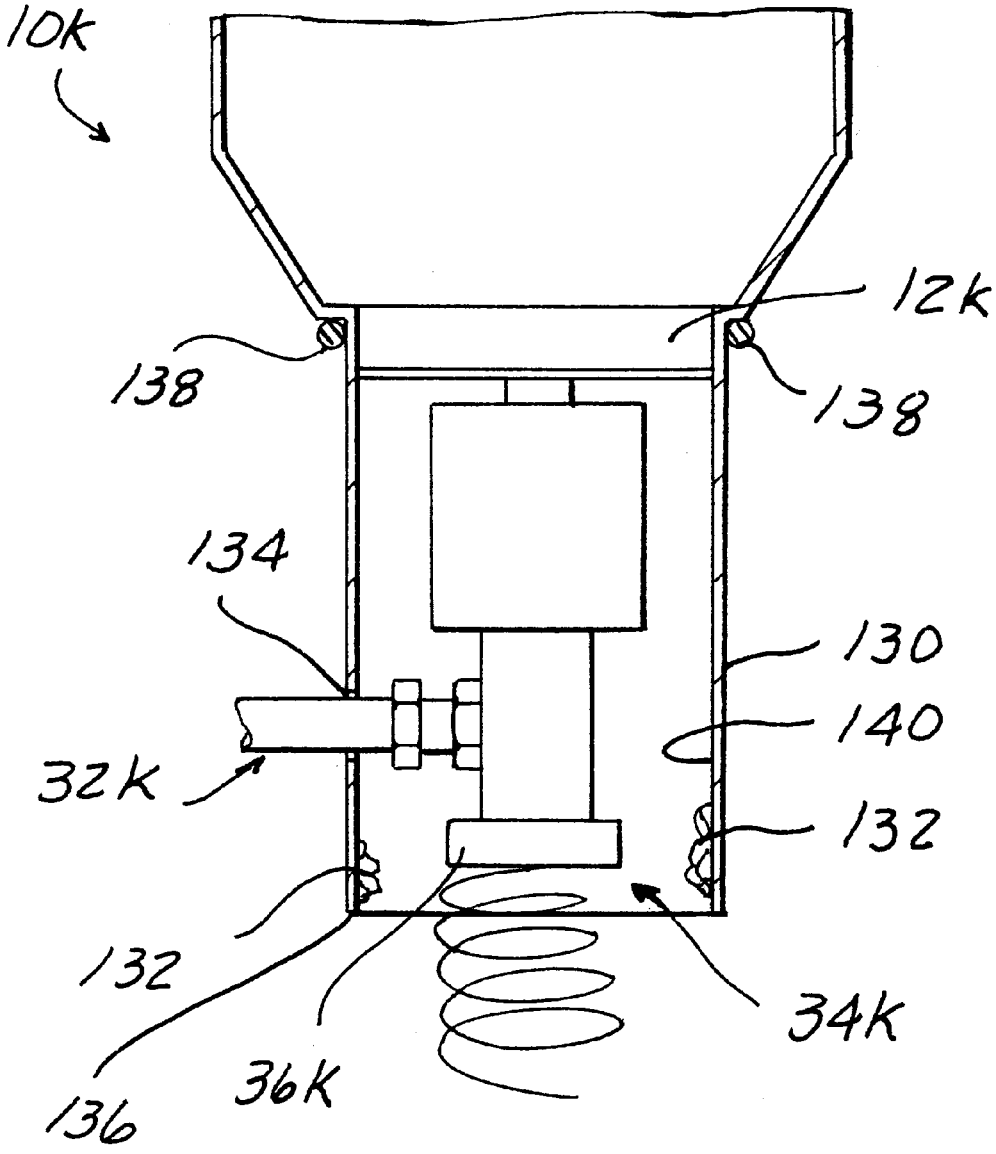
FIG. 32 is a schematic view of an orbital applicator tool according to the present invention with a shield.

Referring now to FIG. 32, the orbital applicator tool of the present invention can include a shield 130. In some applications, especially applications in which the orbital applicator tool applies material in a swirl pattern, small droplets of slung material 132 can be inadvertently directed or slung away from the workpiece. The shield 130 can be positioned to collect these small droplets of slung material 132. The shield 130 can be fabricated from paper or plastic material. The shield 130 should be fabricated with a material that is relatively inexpensive to insure that the shield 130 is disposable. The shield 130 overcomes the problem in the current art wherein shields are fabricated from steel, are used several times and cleaned. The process of cleaning steel shields is time consuming and the shield 130 of the present invention overcomes this problem by being disposable. The shield 130 includes opening means 134 for permitting passage of the inlet port 32*k*. Opening means 134 can be an aperture or slot formed in the shield 130. Alternatively, opening means 134 can be a slit formed in the shield 130 extending from upper end 138 towards lower end 136. The shield 130 can be cylindrical in shape with an aperture 140 extending completely there through. Alternatively, the shield 130 can be flat and wrapped around a portion of the orbital applicator tool 10*k*, such as a base 12*k*. The shield 130 can be engaged with the base 12*k* with engaging means 138. Engaging means 138 is shown in FIG. 32 as an O ring. However, engaging means 138 can be bolts, screws or a strap.

Figure 34:
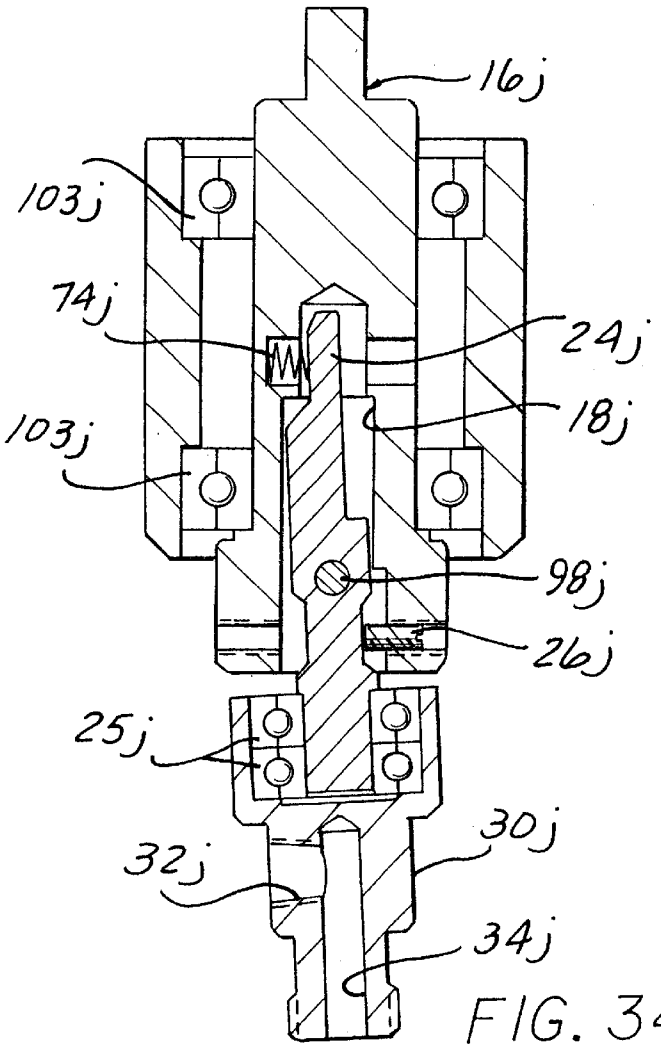
FIG. 34 is a simplified cross-sectional detailed view of the embodiment illustrated in FIG. 3 with the tip or nozzle in an offset position.
Figure 33:
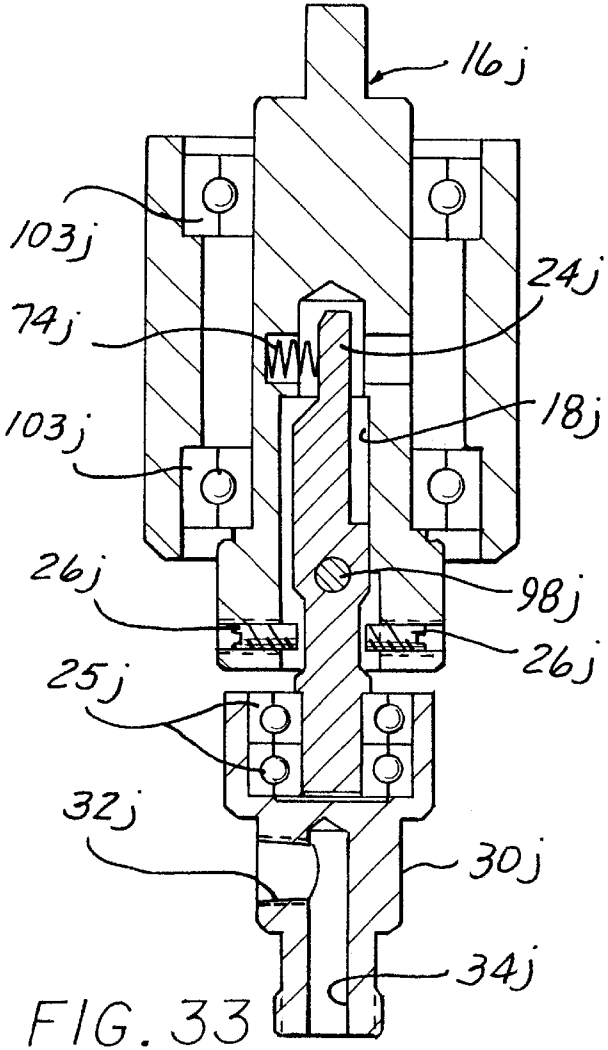
FIG. 33 is a simplified cross-sectional detailed view of a rotatable shaft or housing for converting rotation about an axis into circular orbital movement of a tip or nozzle in an offset position where the tip or nozzle shaft is rotatable about a pivot pin with the tip or nozzle in a self-centering position.

Referring now to FIGS. 33 and 34, the rotatable shaft or housing 16*j* includes a pocket, aperture or bore 18*j* having at least one sidewall extending axially with respect to the axis of rotation. A moveable plate 24*j* is pivotally supported within the aperture 18*j* for adjustable offset movement with respect to the axis of rotation of the rotatable shaft or housing 16*j*. The offset radially movement of the plate or member 24*j* preferably includes movement from a zero, null, or centered position where the axis of rotation of the rotatable shaft or housing 16*j* is coaxial with the longitudinal axis of the orbital element or member 30*j* as shown in FIG. 33 to a maximum radially offset position as shown in FIG. 34 defined by the maximum pivoting movement of the plate or member 24*j* within the pocket, aperture, or bore 18*j*. The plate 24*j* can be adjusted to different radial or angular positions within the pocket, aperture, or bore 18*j* of the rotatable shaft or housing 16*j* by one or more adjustment screws 26*j*. One of the adjustment screws 26*j* can be used to fine tune the zero, null, or centered position of the orbital member 30*j* when the rotatable shaft or housing 16*j* is stationary. Alternatively, one of the adjustment screws 26*j* can be used to drive the plate 24*j* permanently against the wall of the pocket, aperture, or bore 18*j* or against the opposite adjustment screw 26*j* to retain the orbital member 30*j* in a predetermined angular orientation with respect to the axis of rotation of the shaft 16*j*. The plate or member 24*j* is pivotable from the center line of the axis of rotation of the rotatable shaft or housing 16*j* in response to either adjustment of one of the screws 26*j*, or in response to rotation of the rotatable shaft or element 16*j* about the axis of rotation. If self-centering operation is desired, the plate or member 24*j* is driven by centrifugal force in response to rotation of the housing 16*j*. The desired orbital diameter path can be achieved by setting the position of the adjustable screws 26*j*, or with a fixed hard stop, or by changing the distance that the dispersing nozzle is spaced from the part to receive the dispensed material. Preferably, the combination of the plate or member 24*j* and pocket, aperture, or bore 18*j* provide sufficient off center movement to achieve up to approximately 10° offset with respect to the center line or axis of rotation of the shaft 16*j*. It should be understood that off center adjustment greater than 10° can be provided if desired for a particular application. The plate or member 24*j* is pivoted off center with respect to the pocket, aperture, or bore 18*j*, by pivoting about pivot pin 98*j*. Pivot pin 98*j* is mounted within the enlarged aperture 18*j* extending at least partially through the rotatable shaft or housing 16*j* supported by bearings 103*j*. The outer end of the plate or member 24*j* opposite from the pocket, aperture, or bore 18*j* with respect to the pivot pin 98*j* supports one or more bearings 25*j* for mounting the orbital member 30*j*. The elongate orbital member 30*j* is mounted through bearings 25*j* in order to allow the orbital member 30*j* to sweep through the orbital path without rotating to prevent tangling of conduits connected to at least one inlet port 32*j* for the fluid material to be applied. The material passing through the orbital element or member 30*j* is discharged through at least one material outlet port 34*j*, such as through an attached nozzle, sprayer, streamer, or dispersing head. The plate or member 24*j* can be biased toward the zero, null, or centered position with biasing means 74*j*. A set screw 26*j* can be provided for adjusting the outer end limit of travel of the plate or member 24*j*.

The present invention provides means for manual adjusting or changing the pattern width without having to change or reprogram the movable member or robot. The applicator tip height above the surface of the workpiece can remain the same while the throw angle of the nozzle is adjusted by adjusting the adjustable stop, or hard stop. Alternatively, the dispersal pattern can be changed by replacing one nozzle configuration with another. The position of the multiple swirl patterns can also be controlled by the angle of the nozzle orifices in relation to each other (i.e. by exchanging one nozzle configuration for another nozzle configuration) and the travel path center line . Additionally, the pattern width can also be adjusted or changed by varying the travel path of the nozzle (i.e. changing or reprogramming the moveable member or robot) so that the distance of the nozzle tip above the surface of the workpiece to receive the dispersal pattern is increased or decreased. In other words, the present invention provides the ability to vary the width of the material application and/or varying the pattern of material application, by varying the nozzle configuration, by varying the distance of the nozzle from the part, by varying the throw angle of the apertures formed in the nozzle, or by varying the rotational speed of the orbital tool supporting the nozzle, or by varying the linear speed of the moveable member or robot along the travel path for the nozzle. Preferably, according to the present invention, most adjustments required for various applications can be accomplished by a simple adjustment of the orbital offset, sometimes referred to herein as the throw angle, such as by adjusting the adjustable stop or the hard stop for setting the end limit of travel of the throw plate within the slide pocket.

The orbiting tool or swirl tool according to the present invention can be used in automotive assembly applications as previously described above, or can be used in furniture manufacturing. For example, a wooden molded chair can be fabricated with multiple layers of veneer sheets cut to different sizes, glued, stacked, and then placed in a press mold where the sheets are formed and held until the assembly is dry and the sheets are bonded to one another. Typically, the glue for this type of application is applied by passing through a roll coater that applies the glue to the wood sheets. The width of the roll coater is constant while the width of the wood sheets to be coated are of various widths creating processing problems including material accumulation, cleanup, and the like. By arranging multiple swirl tools according to the present invention side by side, the pattern width can be made to match the parts being coated by selectively turning a portion of the tools on and off to only apply glue to the width of the wood sheet passing by the swirl tools.

The swirl tool according to the present invention can be self centering when the rotational speed is zero, or can be preset for a predetermined throw angle by an adjustable stop or a fixed hard stop. The present invention can use kinetic energy available as the result of the spinning motion to throw the counterweighted plate off center when the spindle starts spinning, and can stay in this position until the spindle stops. When the spindle stops, the spring can return the plate back to the center position. The present invention provides material dispensing in a swirl pattern with an array of different shapes and sizes. The present invention provides durability, long life, and less wear. The present invention is self centering automatically in response to rotation. Swirling speeds according to the present invention are anticipated to be up to 20,000 revolutions per minute. The present invention provides a compact design which consumes less space than other rotary dispensing applicators. The throw is adjustable with a throw adjust plate, or set screw, or automated adjustment by hydraulic, or pneumatic piston, solenoid, or electric servo motor controlled screw drive as previously described according to the present invention.

The present invention also includes interchangeable fluid nozzles or inserts for single part materials and dual part materials. The present invention also provides a tip seal nozzle for quick material cutoff when using single part materials, or two part materials. The present invention can be used for streaming adhesive in a straight or swirl pattern in hem flanging applications, for streaming sound deadening materials onto surfaces of workpieces, for spreading seam sealing materials, for coating the inside diameter of cylindrical workpieces, or for coating large surface areas with adhesives, sealants, or sound deadening materials. The present application does not wind up or twist the conduits supplying fluid to the orbiting nozzle. The present invention can be self centering in response to rotation of the shaft. The throw or offset of the orbital path is adjustable. The motor used for producing the orbital motion can be driven by pneumatics, hydraulics, or electricity. The nozzle can be adapted to accept a static mixer and/or a tip shutoff valve. The present invention can also be adapted for use as a hydrojet cutting tool if desired.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An apparatus for imparting movement to a fluid dispersing nozzle comprising:

means for converting rotational movement about an axis of rotation into orbital movement about the axis of rotation; and an elongate orbital member connectible to the converting means and connectible to a fluid nozzle spaced from the converting means, the orbital member providing orbiting movement in response to rotation of the converting means about the rotational axis the orbital member providing stationary centered positioning in response to lack of rotation of the converting means.

2. The apparatus of claim 1 further comprising:

the fluid nozzle for applying a fluid material selected from a group consisting of a sealant material, an adhesive material, and a noise attenuation material.

3. The apparatus of claim 1 further comprising:

means for adjusting a dispersal pattern of the fluid material.

4. The apparatus of claim 3 wherein the adjusting means further comprises:

the fluid nozzle having a plurality of apertures formed therein at equally spaced angular positions with respect to one another.

5. The apparatus of claim 4 wherein the plurality of apertures are identical to one another.

6. The apparatus of claim 4 wherein the plurality of apertures are machined at an angle with respect to a center of the fluid nozzle.

7. The apparatus of claim 4 wherein the plurality of apertures include as central aperture in the fluid nozzle.

8. The apparatus of claim 1 further comprising:

a body defining a fluid passage having at least one fluid inlet port and at least one fluid outlet port associated with the elongate orbital member spaced from the converting means, the fluid passage moveable along an orbital path during rotation of the converting means while the at least one fluid inlet port extends trough a rotationally stationary portion of the body for fluid communication with a nozzle connectible to the at least one fluid outlet port of the body.

9. The apparatus of claim 1 further comprising:

the orbital member pivotally connected to the converting means.

10. The apparatus of claim 1 further comprising:

an elongate applicator housing having an enlarged end and a constricted end; and a mixer positionable within the housing.

11. The apparatus of claim 10 further comprising:

the mixer moveable longitudinally with respect to the housing.

12. The apparatus of claim 11 further comprising:

a tip seal valve member on an end of the movable mixer operably engagable with the constricted end of the applicator housing for stopping and starting flow of fluid to be applied in response to movement of the mixer.

13. The apparatus of claim 12 further comprising:

the tip seal valve member selected from a group consisting of a ball, a tapered cone, and an elongate cylindrical plug.

14. The apparatus of claim 11 further compring:

a piston connectible to an end of the mixer, oppositefrom the constricted end of the housing, for moving the mixer longitudinally within the housing.

15. The apparatus of claim 10 further comprising:

the constricted end defined by a tapered cone formed on the second end to define a reduced diameter relative to the housing to enable streaming of the pressurized fluid to be applied.

16. An apparatus for imparting movement to a fluid dispersing nozzle comprising:

means for converting rotational movement about an axis of rotation into orbital movement about the axis of rotation, wherein the converting means includes a rotatable shaft having a rotational axis and an aperture through at least a portion of the shaft; and an elongate orbital member pivotally supported within the aperture of the shaft for movement between a centered position with respect to the rotational axis and a displaced position with respect to the rotational axis, wherein movement between the centered position and the displaced position is in response to rotational movement of the shaft, the elongate orbital member connectible to the converting means and connectible to a fluid nozzle spaced from the converting means, the orbital member providing orbiting movement in response to rotation of the converting means about the rotational axis.

17. The apparatus of claim 16 further comprising:

the orbital member providing stationary centered positioning in response to lack of rotation of the converting means.

18. The apparatus of claim 16 further comprising:

an adjustable screw for adjusting an amount of transverse movement of the orbital member in response to rotational movement of the shaft.

19. The apparatus of claim 16 further comprising:

means for rotatably driving the shaft about the rotational axis.

20. The apparatus of claim 19 wherein the driving means further comprises an in-line motor connectible to the shaft.

21. The apparatus of claim 19 wherein the driving means further comprises an offset motor connectible to the shaft through a rotary transmission.

22. The apparatus of claim 21 wherein the rotary transmission further comprises a first pulley connectible to the motor, a second pulley connectible to the shaft, and a drive belt operably engageable between the first and second pulleys to transfer rotary motion of the motor to the shaft.

23. The apparatus of claim 16 further comprising:

biasing means for urging the orbital member toward the centered position when the shaft is stationary.

24. The apparatus of claim 23 wherein the biasing means further comprises a spring engaged between the shaft and the orbital member of sufficient strength to move the orbital member to the centered position when the shaft is not rotating.

25. The apparatus of claim 16 further comprising:

adjustable means for setting the centered position of the orbital member with respect to the rotational axis of the shaft.

26. The apparatus of claim 25 wherein the adjustable means further comprises at least one set screw defining a stop for the orbital member at the centered position.

27. The apparatus of claim 16 further comprising:

a support plate for supporting the shaft and the orbital member relative to one another; and a bracket connected to the support plate and connectible with a moveable member for movement along a predetermined path.

28. The apparatus of claim 27 wherein the moveable member is a wrist of a programmable robot.

29. A method for imparting movement to a fluid dispersing nozzle comprising the steps of:

converting rotational movement about an axis of rotation into orbital movement about the axis of rotation with converting means;

connecting an elongate orbital member to the converting means and a fluid nozzle spaced from the converting means, the orbital member providing orbiting movement in response to rotation of the converting means about the rotational axis; and positioning the orbital member in a stationary centered position in response to a lack of rotation of the converting means.

30. The method of claim 29 further comprising the steps of:

supporting the shaft and the orbital member relative to one another with a support plate; and connecting a bracket to the support plate, the bracket connectible with a moveable member for movement along a predetermined path.

31. The method of claim 30 wherein the moveable member is a wrist of a programmable robot.

32. The method of claim 29 further comprising the step of:

applying a fluid material selected from a group consisting of a sealant material, an adhesive material, and a noise attenuation material with the fluid nozzle.

33. The method of claim 29 further comprising the step of:

adjusting a dispersal pattern of the fluid material with adjusting means.

34. The method of claim 33 wherein the adjusting step further comprises the step of:

forming a plurality of apertures in the fluid nozzle at equally spaced angular positions with respect to one another.

35. The method of claim 34 wherein the plurality of apertures are identical to one another.

36. The method of claim 34 wherein the plurality of apertures are machined at an angle with respect to a center of the fluid nozzle.

37. The method of claim 34 wherein the plurality of apertures include a central aperture in the fluid nozzle.

38. The method of claim 29 further comprising the step of:

associating a body defining a fluid passage having at least one fluid inlet port and at least one fluid outlet port with the elongate orbital member spaced from the converting means, the fluid passage moveable along an orbital path during rotation of the converting means while the at least one fluid inlet port extends through a rotationally stationary portion of the body for fluid communication with a nozzle connectible to at least one fluid outlet port of the body.

39. The method of claim 29 further comprising the step of:

pivotally connecting the orbital member to the converting means.

40. The method of claim 29 further comprising the steps of:

providing an elongate applicator housing with an enlarged end and a constricted end; and positioning a mixer within the housing.

41. The method of claim 40 further comprising the step of:

longitudinally moving the mixer with respect to the housing.

42. The method of claim 41 further comprising the step of:

a piston connectible to an end of the mixer, opposite from the constricted end of the housing, for moving the mixer longitudinally within the housing.

43. The method of claim 41 further comprising the step of:

providing a tip seal valve member on an end of the movable mixer, the tip seal valve member operably engagable with the constricted end of the applicator housing for stopping and starting flow of fluid to be applied in response to movement of the mixer.

44. The method of claim 43 further comprising the step of:

selecting the tip seal valve member from a group consisting of a ball, a tapered cone, and an elongate cylindrical plug.

45. The method of claim 40 further comprising the step of:

forming the constricted end defined by a tapered cone on the second end to define a reduced diameter relative to the housing to enable streaming of the pressurized fluid to be applied.

46. A method for imparting movement to a fluid dispersing nozzle comprising the steps of:

converting rotational movement about an axis of rotation into orbital movement about the axis of rotation with converting means, wherein the converting step includes the steps of rotating a rotatable shaft having a rotational axis, the shaft having an aperture through at least a portion of the shaft, and pivotally engaging an elongate orbital member within the aperture of the shaft for movement between a centered position with respect to the rotational axis and a displaced position with respect to the rotational axis, wherein movement between the centered position and the displaced position is in response to rotational movement of the shaft; and connecting the elongate orbital member to the converting means and a fluid nozzle spaced from the converting means, the orbital member providing orbiting movement in response to rotation of the converting means about the rotational axis.

47. The method of claim 46 further comprising the step of:

positioning the orbital member in a stationary centered position in response to a lack of rotation of the converting means.

48. The method of claim 46 wherein the converting step further comprises the step of:

adjusting an amount of transverse movement of the orbital member in response to rotational movement of the shaft with a set screw.

49. The method of claim 46 further comprising the step of:

rotatably driving the shaft about the rotational axis with driving means.

50. The method of claim 49 wherein the driving step further comprises the step of connecting an in-line motor to the shaft.

51. The method of claim 49 wherein the driving step further comprises the step of connecting an offset motor to the shaft through a rotary transmission.

52. The method of claim 51 wherein the connecting step for the rotary transmission further comprises the steps of:

connecting a first pulley to the motor;

connecting a second pulley to the shaft; and operably engaging a drive belt between the first and second pulleys to transfer rotary motion of the motor to the shaft.

53. The method of claim 46 further comprising the step of:

urging the orbital member toward the centered position when the shaft is stationary with biasing means.

54. The method of claim 53 wherein the urging step further comprises the step of engaging a spring between the shaft and the orbital member of sufficient strength to move the orbital member to the centered position when the shaft is not rotating.

55. The method of claim 46 further comprising the step of:

setting the centered position of the orbital member with respect to the rotational axis of the shaft with adjustable means.

56. The method of claim 55 wherein the adjusting means further comprises at least one set screw defining a stop for the orbital member at the centered position.

57. An apparatus for imparting movement to a fluid dispersing nozzle comprising:

means for converting rotational movement about an axis of rotation into orbital movement about the axis of rotation;

an elongate orbital member connectible to the converting means, the orbital member providing orbiting movement in response to rotation of the converting means about the rotational axis, at least one fluid passage extending through a collar portion of the orbital member, each fluid passage having an inlet port connectible to a pressurized source of fluid to be dispersed and an outlet port connectible to a fluid nozzle spaced from the converting means, the collar portion supported by a rotary connection for maintaining the collar portion in a non-rotating orientation, while allowing the collar portion to be driven with the orbiting movement of the elongate orbital member.

58. The apparatus of claim 57, wherein the ro tary connection includes at least one ball bearing.

* * * * *